US010255838B2

(12) United States Patent
Yoneda et al.

(10) Patent No.: US 10,255,838 B2
(45) Date of Patent: Apr. 9, 2019

(54) SEMICONDUCTOR DEVICE AND ELECTRONIC DEVICE

(71) Applicant: SEMICONDUCTOR ENERGY LABORATORY CO., LTD., Atsugi-shi, Kanagawa-ken (JP)

(72) Inventors: Seiichi Yoneda, Kanagawa (JP); Yuki Okamoto, Kanagawa (JP); Yoshiyuki Kurokawa, Kanagawa (JP)

(73) Assignee: Semiconductor Energy Laboratory Co., Ltd., Kanagawa-ken (JP)

( * ) Notice: Subject to any disclaimer, the term of this patent is extended or adjusted under 35 U.S.C. 154(b) by 0 days.

(21) Appl. No.: 15/654,802

(22) Filed: Jul. 20, 2017

(65) Prior Publication Data

US 2018/0033359 A1 Feb. 1, 2018

(30) Foreign Application Priority Data

Jul. 27, 2016 (JP) ..... 2016-147070

(51) Int. Cl.
*G09G 3/20* (2006.01)
*G09G 3/36* (2006.01)
(Continued)

(52) U.S. Cl.
CPC ..... *G09G 3/2003* (2013.01); *G09G 3/3413* (2013.01); *G09G 3/3648* (2013.01);
(Continued)

(58) Field of Classification Search
CPC .. G09G 3/2003; G09G 3/3413; G09G 3/3648; G09G 3/3225; G09G 2300/023;
(Continued)

(56) References Cited

U.S. PATENT DOCUMENTS 6,275,207 B1 * 8/2001 Nitta ..... G09G 3/2011 345/89
6,714,268 B2 3/2004 Wang et al.
(Continued)

FOREIGN PATENT DOCUMENTS

JP 2001-066593 A 3/2001
JP 2002-196702 A 7/2002
(Continued)

OTHER PUBLICATIONS

Lee.J et al., "High ambient-contrast-ratio display using tandem reflective liquid crystal display and organic light-emitting device", Optics Express, Nov. 14, 2005, vol. 13, No. 23, pp. 9431-9438.
(Continued)

*Primary Examiner* — Stephen G Sherman
(74) *Attorney, Agent, or Firm* — Nixon Peabody LLP; Jeffrey L. Costellia

(57) ABSTRACT

Provided is a semiconductor device in which power consumption and rewrite time needed for changing the parameter for color adjustment, dimming, or the like are reduced. One embodiment of a semiconductor device of the present invention includes an image processing portion including a plurality of functional circuits configured to correct image data, a plurality of scan chains corresponding to the plurality of functional circuits, and a controller controlling operations of the plurality of scan chains. During a state in which the controller controls the scan chains so that one or more scan chains chosen from the plurality of scan chains are driven and the scan chains except for the one or more scan chains are not driven, a parameter stored in one or more functional circuits connected to the one or more scan chains is rewritten.

13 Claims, 21 Drawing Sheets

(51) Int. Cl.
*G09G 3/34* (2006.01)
*G09G 3/32* (2016.01)
*G09G 3/3225* (2016.01)

(52) U.S. Cl.
CPC ..... *G09G 3/3225* (2013.01); *G09G 2300/023* (2013.01); *G09G 2300/0456* (2013.01); *G09G 2320/0276* (2013.01); *G09G 2320/0646* (2013.01); *G09G 2320/0666* (2013.01); *G09G 2360/144* (2013.01)

(58) Field of Classification Search
CPC ... G09G 2300/0456; G09G 2320/0276; G09G 2320/0646; G09G 2320/0666; G09G 2360/144; G09G 2320/0673
See application file for complete search history.

(56) References Cited

U.S. PATENT DOCUMENTS

| | | | |
|---|---|---|---|
| 7,038,641 | B2 | 5/2006 | Hirota et al. |
| 7,084,936 | B2 | 8/2006 | Kato |
| 7,102,704 | B2 | 9/2006 | Mitsui et al. |
| 7,176,991 | B2 | 2/2007 | Mitsui et al. |
| 7,239,361 | B2 | 7/2007 | Kato |
| 7,248,235 | B2 | 7/2007 | Fujii et al. |
| 7,385,654 | B2 | 6/2008 | Mitsui et al. |
| 9,190,172 | B2 * | 11/2015 | Ohmaru ..... G01R 31/318597 |
| 9,948,303 | B2 * | 4/2018 | Narayanan ..... H03K 19/0013 |
| 2003/0052869 | A1 | 3/2003 | Fujii et al. |
| 2003/0201960 | A1 | 10/2003 | Fujieda |
| 2006/0072047 | A1 | 4/2006 | Sekiguchi |
| 2008/0180618 | A1 | 7/2008 | Fujieda |
| 2009/0033645 | A1 | 2/2009 | Araya |
| 2010/0149138 | A1 | 6/2010 | Lee et al. |
| 2010/0171905 | A1 | 7/2010 | Huang et al. |
| 2011/0090183 | A1 | 4/2011 | Yamazaki et al. |
| 2011/0090207 | A1 | 4/2011 | Yamazaki et al. |
| 2011/0156027 | A1 | 6/2011 | Yamazaki et al. |
| 2011/0161574 | A1 | 6/2011 | Minami |
| 2013/0134416 | A1 | 5/2013 | Nishijima et al. |
| 2013/0235689 | A1 | 9/2013 | Koyama |
| 2013/0256657 | A1 | 10/2013 | Yamazaki et al. |
| 2014/0002425 | A1 | 1/2014 | Hirakata et al. |
| 2014/0068300 | A1 | 3/2014 | Nishijima et al. |
| 2014/0108836 | A1 | 4/2014 | Nishijima et al. |
| 2014/0208142 | A1 | 7/2014 | Tamura |
| 2014/0368417 | A1 | 12/2014 | Yamazaki et al. |
| 2015/0070254 | A1 | 3/2015 | Yamazaki et al. |
| 2016/0035275 | A1 | 2/2016 | Yamazaki et al. |
| 2016/0070386 | A1 | 3/2016 | Yamamoto et al. |
| 2016/0232868 | A1 | 8/2016 | Yamazaki et al. |
| 2016/0260718 | A1 | 9/2016 | Yamazaki et al. |
| 2017/0004788 | A1 | 1/2017 | Yamazaki et al. |
| 2017/0177116 | A1 | 6/2017 | Jinbo et al. |
| 2017/0337884 | A1 | 11/2017 | Kurokawa |

FOREIGN PATENT DOCUMENTS

| | | | |
|---|---|---|---|
| JP | 2004-296162 | A | 10/2004 |
| JP | 2007-232882 | A | 9/2007 |
| JP | 2013-120319 | A | 6/2013 |
| JP | 2013-221965 | A | 10/2013 |

OTHER PUBLICATIONS

Shieh.H, "Transflective display by Hybrid OLED and LCD", LEOS 2005 (IEEE Lasers and Electro-Optics Society Annual Meeting) , Oct. 22, 2005. pp. 650-651, IEEE.

* cited by examiner

SEMICONDUCTOR DEVICE AND ELECTRONIC DEVICE

BACKGROUND OF THE INVENTION

1. Field of the Invention

One embodiment of the present invention relates to a semiconductor device.

Note that one embodiment of the present invention is not limited to the above technical field. Specific examples of the technical field of one embodiment of the present invention disclosed in this specification and the like include a semiconductor device, a display device, an electronic device, a method for driving any of them, and a method for manufacturing any of them. In this specification and the like, a semiconductor device generally means a device that can function by utilizing semiconductor characteristics.

2. Description of the Related Art

A display device in which a reflective element and a light-emitting element are combined is proposed (Patent Document 1). The display device is characterized in that the reflective element is used in a bright environment and the light-emitting element is used in a dark environment, achieving high display quality independent of ambient light and consuming little power.

REFERENCE

U.S. Pat. No. 7,248,235

SUMMARY OF THE INVENTION

The display of a display device in which a reflective element and a light-emitting element are combined is controlled with a controller IC. The controller IC has a function of correcting image data using various parameters for color adjustment and dimming, for example, to achieve optimal visibility adapting to the surrounding environment. A controller IC with such a function include, for example, a scan chain 300 and an image processing portion 301 (refer to FIG. 3). The scan chain 300 is connected to a parameter input pin (Scan In) to which data of a parameter are input, a clock pin (Scan Clock) to which a clock signal is input, and an output pin (Scan Out) from which data are output.

The image processing portion 301 includes a module connector 302 and functional circuits 303 to 306 that are connected to the module connector 302. Image data (Data X) are input to the module connector 302. Various parameters for color adjustment, dimming, and the like are supplied from the parameter input pin, through the scan chain 300, to the functional circuits 303 to 306. The functional circuits 303 to 306 correct image data (Data Xa to Xd, denoted as Xa, Xb, Xc, and Xd in FIG. 3) that are input through the module connector 302 with the parameters, and output the corrected image data (Data Ya to Yd, denoted as Ya, Yb, Yc, and Yd in FIG. 3) to the module connector 302. The corrected image data are output to the outside (e.g., source driver) as image data (Data Y) by the module connector 302. The image data (Data X) include at least one of the image data Xa to Xd, and the image data (Data Y) include at least one of the image data Ya to Yd.

Distances between the parameter input pin and the functional circuits 303 to 306 are each different. In the controller IC of FIG. 3, the functional circuit 303 is positioned closest to the parameter input pin, and the functional circuit 306 is positioned farthest from the parameter input pin. In the case that the parameter of the functional circuit 306, which is the farthest from the parameter input pin, is to be changed, it takes time for data to travel from the parameter input pin to the functional circuit 306. In other words, time needed for a rewrite is long, although the amount of data to be rewritten is small. In addition, the clock signal is shared through the entire scan chain 300, leading to high power consumption.

Accordingly, an object of one embodiment of the present invention is to provide a controller IC in which power consumption and rewrite time needed for changing the parameter for color adjustment, dimming, or the like are reduced.

Note that the controller IC is a semiconductor device that includes a transistor including a semiconductor at least in a channel formation region. Accordingly, the controller IC may be referred to as a semiconductor device.

One embodiment of the present invention does not necessarily achieve all the objects listed above and only needs to achieve at least one of the objects. The description of the above objects does not preclude the existence of other objects. Other objects will be apparent from and can be derived from the description of the specification, the drawings, the claims, and the like.

One embodiment of a semiconductor device of the present invention includes an image processing portion including a plurality of functional circuits configured to correct image data, a plurality of scan chains corresponding to the plurality of functional circuits, and a controller controlling operations of the plurality of scan chains. During a state in which the controller controls the scan chains so that one or more scan chains chosen from the plurality of scan chains are driven and the scan chains except for the one or more scan chains are not driven, a parameter stored in one or more functional circuits connected to the one or more scan chains is rewritten.

The semiconductor device of the embodiment above includes a plurality of transistors that are provided between the plurality of scan chains and the controller, and each of the plurality of transistors includes an oxide semiconductor in its channel formation region.

The semiconductor device of the embodiment above further includes a pixel array that includes a plurality of pixels including a reflective element and a light-emitting element.

In the semiconductor device of the embodiment above, one of the plurality of functional circuits is a color adjustment circuit that stores a parameter to adjust a color tone of at least one of the reflective element and the light-emitting element, and corrects the image data using the stored parameter.

In the semiconductor device of the embodiment above, one of the plurality of functional circuits is a dimming circuit that stores a parameter to adjust a reflection intensity of the reflective element and an emission intensity of the light-emitting element, and corrects the image data using the stored parameter.

In the semiconductor device of the embodiment above, one of the plurality of functional circuits is a gamma correction circuit that stores a gamma value as a parameter and corrects the image data using the gamma value.

One embodiment of the present invention can provide a semiconductor device in which power consumption and rewrite time needed for changing a parameter for color adjustment, dimming, or the like are reduced.

Note that the effect of one embodiment of the present invention is not limited to the effect described above. The effect described above do not preclude the existence of other effects. The other effects are the ones that are not described above and will be described below. The other effects will be apparent from and can be derived from the description of the specification, the drawings, and the like by those skilled in the art. Note that one embodiment of the present invention has at least one of the above effects and the other effects. Accordingly, one embodiment of the present invention does not have the above effects in some cases.

DETAILED DESCRIPTION OF THE INVENTION

Figure 1:
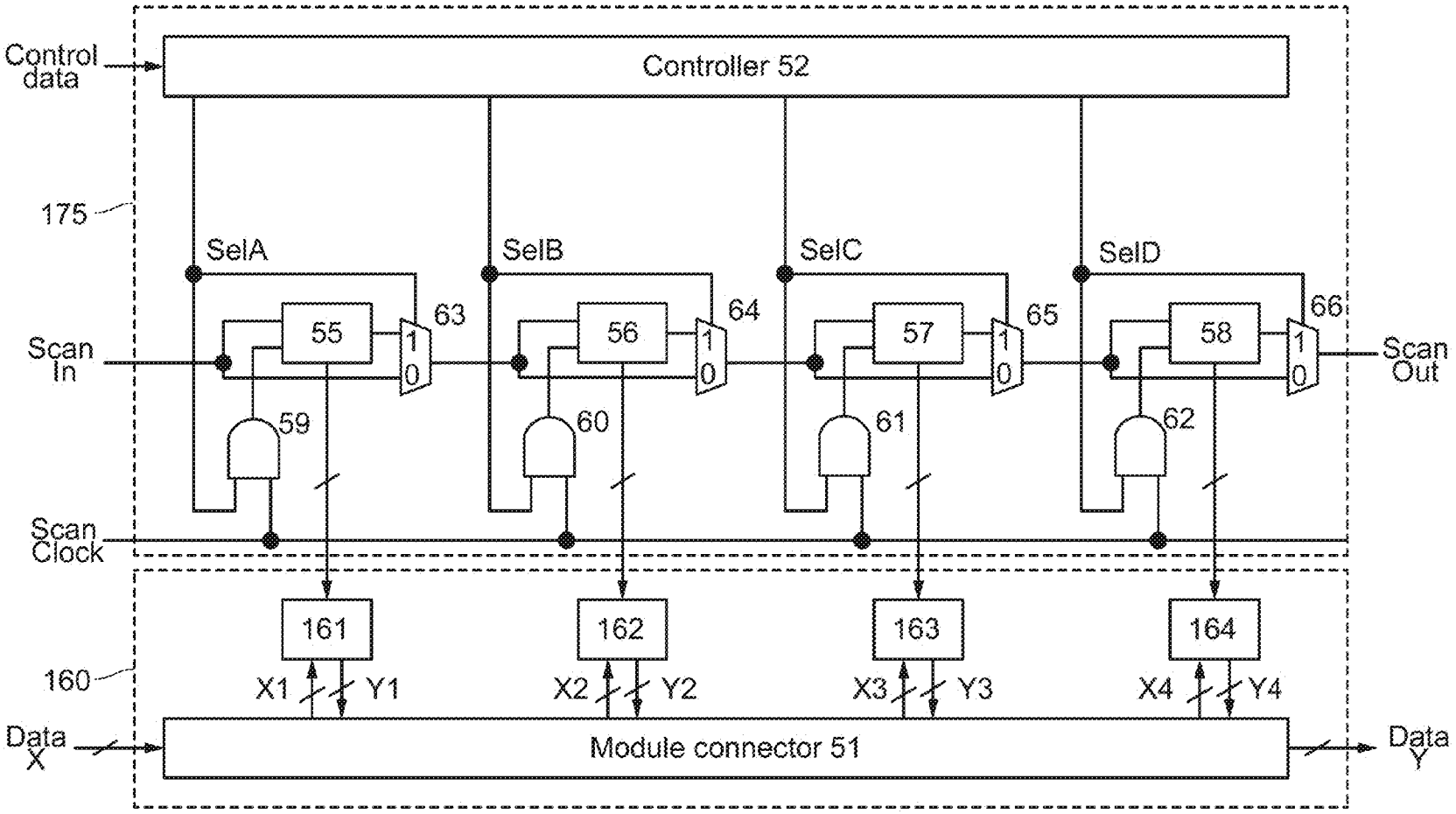
FIG. 1 illustrates a configuration of a controller IC.

Hereinafter, embodiments will be described with reference to drawings. However, the embodiments can be implemented with various modes. It will be readily appreciated by those skilled in the art that modes and details can be changed in various ways without departing from the spirit and scope of the present invention. Thus, the present invention should not be interpreted as being limited to the following description of the embodiments. Any of the embodiments described below can be combined as appropriate.

In this specification and the like, a metal oxide means an oxide of metal in a broad sense. Metal oxides are classified into an oxide insulator, an oxide conductor (including a transparent oxide conductor), an oxide semiconductor (also simply referred to as an OS), and the like. For example, a metal oxide used in a channel formation region of a transistor is called an oxide semiconductor in some cases. That is to say, a metal oxide that has at least one of an amplifying function, a rectifying function, and a switching function can be called a metal oxide semiconductor, or OS for short. Thus, a transistor including an oxide semiconductor in a channel formation region is referred to as an OS transistor in some cases. Conversely, a transistor including silicon is referred to as a Si transistor in some cases.

In this specification and the like, a metal oxide including nitrogen is also called a metal oxide in some cases. Moreover, a metal oxide including nitrogen may be called a metal oxynitride.

In this specification and the like, an expression such as "c-axis aligned crystal (CAAC)" or "cloud-aligned composite (CAC)" may be used in some cases. CAAC refers to an example of a crystal structure, and CAC refers to an example of a function or a material composition.

In this specification and the like, a CAC-OS or a CAC metal oxide has a conducting function in a part of the material and has an insulating function in another part of the material; as a whole, the CAC-OS or the CAC metal oxide has a function of a semiconductor. In the case where the CAC-OS or the CAC metal oxide is used in a channel formation region of a transistor, the conducting function is to allow electrons (or holes) serving as carriers to flow, and the insulating function is to not allow electrons serving as carriers to flow. By the complementary action of the conducting function and the insulating function, the CAC-OS or the CAC metal oxide can have a switching function (on/off function). In the CAC-OS or CAC-metal oxide, separation of the functions can maximize each function.

In this specification and the like, the CAC-OS or the CAC metal oxide includes conductive regions and insulating regions. The conductive regions have the above-described conducting function, and the insulating regions have the above-described insulating function. In some cases, the conductive regions and the insulating regions in the material are separated at the nanoparticle level. In some cases, the conductive regions and the insulating regions are unevenly distributed in the material. The conductive regions are observed to be coupled in a cloud-like manner with their boundaries blurred, in some cases.

Furthermore, in the CAC-OS or the CAC metal oxide, the conductive regions and the insulating regions each have a size of more than or equal to 0.5 nm and less than or equal to 10 nm, preferably more than or equal to 0.5 nm and less than or equal to 3 nm and are dispersed in the material, in some cases.

The CAC-OS or the CAC metal oxide includes components having different bandgaps. For example, the CAC-OS or the CAC metal oxide includes a component having a wide gap due to the insulating region and a component having a narrow gap due to the conductive region. In the case of such a composition, carriers mainly flow in the component having a narrow gap. The component having a narrow gap complements the component having a wide gap, and carriers also flow in the component having a wide gap in conjunction with the component having a narrow gap. Therefore, in the case where the above-described CAC-OS or the CAC metal oxide is used in a channel region of a transistor, high current drive capability in the on state of the transistor, that is, high on-state current and high field-effect mobility, can be obtained.

In other words, CAC-OS or CAC-metal oxide can be called a matrix composite or a metal matrix composite.

In the drawings, the size, the layer thickness, the region, or the like is sometimes exaggerated for clarity, and thus is not limited to the illustrated scale. Therefore, the size, the layer thickness, or the region is not limited to the illustrated scale. Note that the drawings are schematic views showing ideal examples, and embodiments of the present invention are not limited to shapes or values shown in the drawings.

In the drawings and the like, the same elements, elements having similar functions, elements formed of the same material, elements formed at the same time, and the like are sometimes denoted by the same reference numerals, and the description thereof is not repeated in some cases.

In this specification and the like, the terms "film" and "layer" can be interchanged with each other depending on the case or circumstances. For example, the term "conductive layer" can be changed into the term "conductive film" in some cases. Also, the term "insulating film" can be changed into the term "insulating layer" in some cases.

Note that in this specification and the like, the terms for describing arrangement such as "above" and "below" do not necessarily mean "directly above" and "directly below", respectively, in the description of a physical relationship between components. For example, the expression "a gate electrode over a gate insulating layer" can mean the case where there is an additional component between the gate insulating layer and the gate electrode.

In this specification and the like, ordinal numbers such as "first", "second", and the like are used in order to avoid confusion among components, and the terms do not limit the components numerically.

In this specification and the like, the term "electrically connected" includes the case where components are connected through an object having any electric function. There is no particular limitation on the "object having any electric function" as long as electric signals can be transmitted and received between components that are connected through the object. Examples of an "object having any electric function" are a switching element such as a transistor, a resistor, an inductor, a capacitor, and an element with a variety of functions as well as an electrode and a wiring.

In this specification and the like, the term "voltage" often refers to a difference between a given potential and a reference potential (e.g., a ground potential). Accordingly, voltage, potential, and potential difference can also be referred to as potential, voltage, and voltage difference, respectively.

In this specification and the like, a transistor is an element having at least three terminals: a gate, a drain, and a source. In addition, the transistor has a channel region between a drain (a drain terminal, a drain region, or a drain electrode) and a source (a source terminal, a source region, or a source electrode), and current can flow between the drain and the source through the channel region. Note that in this specification and the like, a channel region refers to a region through which current mainly flows.

Furthermore, functions of a source and a drain might be switched when transistors having different polarities are employed or a direction of current flow is changed in circuit operation, for example. Therefore, the terms "source" and "drain" can be used interchangeably in this specification and the like.

Unless otherwise specified, off-state current in this specification and the like refers to drain current of a transistor in an off state (also referred to as a non-conducting state and a cutoff state). Unless otherwise specified, the off state of an n-channel transistor means that the voltage between its gate and source (Vgs: gate-source voltage) is lower than the threshold voltage Vth, and the off state of a p-channel transistor means that the gate-source voltage Vgs is higher than the threshold voltage Vth. For example, the off-state current of an n-channel transistor sometimes refers to a drain current that flows when the gate-source voltage Vgs is lower than the threshold voltage Vth.

In the above description of off-state current, a drain may be replaced with a source. That is, the off-state current sometimes refers to current that flows through a source of a transistor in the off state.

In this specification and the like, the term "leakage current" sometimes expresses the same meaning as "off-state current". In this specification and the like, the off-state current sometimes refers to a current that flows between a source and a drain when a transistor is off, for example.

Embodiment 1

A configuration of a controller IC of this embodiment is described with reference to FIGS. 1 and 2.

The controller IC of this embodiment includes an image processing portion 160 and a register 175 (see FIG. 1). The image processing portion 160 includes a module connector 51 and functional circuits 161 to 164 that are connected to the module connector 51 and each store a parameter for dimming, color adjustment, or the like. Image data (Data X) are input to the module connector 51. The functional circuits 161 to 164 correct image data (Data X1 to X4, denoted as X1, X2, X3, and X4 in FIG. 1) that are input through the module connector 51 using the parameters, and output the corrected image data (Data Y1 to Y4, denoted as Y1, Y2, Y3, and Y4 in FIG. 1) to the module connector 51. The corrected image data are output to the outside (e.g., source driver) as image data (Data Y) by the module connector 51. The image data (Data X) include at least one of the image data X1 to X4, and the image data (Data Y) include at least one of the image data Y1 to Y4.

The register 175 includes a controller 52 to which control data are supplied, scan chains 55 to 58, AND circuits 59 to 62, and selectors 63 to 66. Note that this embodiment illustrates an example in which the register 175 includes AND circuits, but circuits used in the register 175 are not limited to AND circuits and another known circuit may be used.

The scan chains 55 to 58 are connected to a parameter input pin (Scan In, also referred to as an input terminal in some cases) and an output pin (Scan Out, also referred to as an output terminal in some cases). In addition, the scan chains 55 to 58 are connected to a clock pin (Scan Clock, also referred to as a clock line in some cases) through the AND circuits 59 to 62, and are connected to the controller 52 through the selectors 63 to 66. The scan chains 55, 56, 57, and 58 are provided corresponding to the functional circuits 161, 162, 163, and 164, respectively. Each of the scan chains 55 to 58 has a function of outputting a parameter supplied from the parameter input pin to one of the functional circuits 161 to 164 that corresponds to the parameter, and its operation is controlled with the controller 52.

The controller IC of this embodiment is characterized in that only the scan chain that corresponds to the functional circuit that needs a parameter change is driven and the other scan chains are not driven, enabling a reduction in data rewrite time and power consumption.

An example in which the scan chain 56 is driven and the scan chains 55, 57, and 58 are not driven is described below. In addition, in the following description, a node between the controller 52 and the scan chain 55 is designated as SelA, a node between the controller 52 and the scan chain 56 is designated as SelB, a node between the controller 52 and the scan chain 57 is designated as SelC, and a node between the controller 52 and the scan chain 58 is designated as SelD.

First, control data are supplied to the controller 52. The control data are data containing information to drive only the scan chain 56. The control data are supplied to the selectors 63 to 66 and the AND circuits 59 to 62, and in response to the control data, nodes SelA, SelB, SelC, and SelD are set at 0, 1, 0, and 0, respectively. In this case, owing to the operation of the selectors 63 to 66, data of parameters supplied from the parameter input pin do not pass through the scan chains 55, 57, and 58, and do pass through the scan chain 56. In a similar manner, owing to the operation of the AND circuits 59 to 62 with the control data, a clock signal that is supplied from the clock pin is supplied only to the scan chain 56.

In this state, the parameter input pin supplies data of a parameter for rewriting the parameter to the functional circuit 162. Subsequently, the data reach the scan chain 56 and the parameter in the functional circuit 162 is changed, enabling a fast rewrite of the parameter in the functional circuit 162. Furthermore, the clock signal supplied from the clock pin is supplied only to the scan chain 56, enabling low power consumption.

The description above describes a case in which one scan chain is driven while the other scan chains are not driven; however, the present invention is not limited thereto. The scan chain to be driven is determined based on whether the parameter stored by the functional circuit corresponding to the scan chain needs to be changed. For example, when each of the parameters stored in two of the functional circuits needs to be changed, the scan chains are controlled so that the two scan chains corresponding to the two functional circuits are driven, and the remaining scan chains (i.e., the scan chains excluding the two scan chains) are not driven.

Next, a modification example of the controller IC in FIG. 1 is described with reference to FIG. 2. The controller IC in FIG. 2 is different from the controller IC in FIG. 1 in that transistors 67 to 70 are newly added. The transistor 67 is provided between the controller 52 and the scan chain 55, the transistor 68 is provided between the controller 52 and the scan chain 56, the transistor 69 is provided between the controller 52 and the scan chain 57, and the transistor 70 is provided between the controller 52 and the scan chain 58. A gate of each of the transistors 67 to 70 is connected to the controller 52. The controller 52 has a function of controlling the switching operation of the transistors 67 to 70.

Each of the transistors 67 to 70 is preferably a transistor including an oxide semiconductor in a channel formation region (OS transistor). The off-state current of the OS transistor can be made extremely low by reducing the concentration of impurities in an oxide semiconductor to make the oxide semiconductor intrinsic or substantially intrinsic. By using the OS transistor with extremely low off-state current as each of the transistors 67 to 70, the transistors 67 to 70 can be turned off after the control data supplied from the controller 52 are output to the nodes SelA, SelB, SelC, and SelD, enabling control data output to the nodes to be stored over a long time. Thus, the controller 52 can be turned off after the controller 52 outputs the control data. Accordingly, a controller IC with further reduction in power consumption can be provided.

Next, a specific configuration of the scan chains 55 to 58 are described with reference to FIGS. 4A and 4B and FIG. 5. In the description below, an example of the scan chain 55 from the scan chains 55 to 58 is described. Scan chains 56 to 58 have a similar configuration as that of the scan chain 55.

Figure 4A:
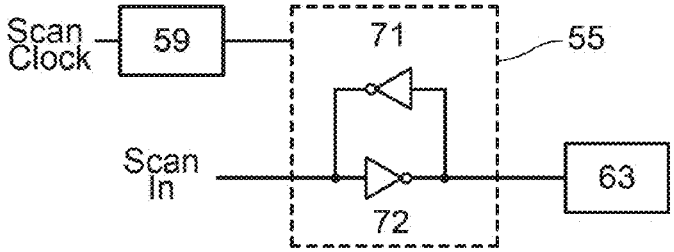
FIGS. 4A and 4B each illustrate a configuration of a scan chain.
Figure 4B:
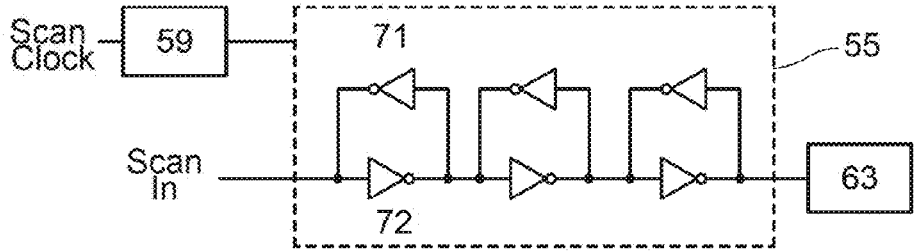

The scan chain 55 in FIG. 4A includes one stage of a flip-flop circuit that includes inverters 71 and 72. The scan chain 55 in FIG. 4B includes three stages of flip-flop circuits each of which includes the inverters 71 and 72. As illustrated in FIGS. 4A and 4B, the number of stages of flip-flop circuits is not particularly limited; however, the number of stages of flip-flop circuits preferably matches the number of bits of the parameter for the corresponding functional circuit. For example, when the functional circuit takes 1-bit data, one stage of a flip-flop circuit is preferably used as illustrated in FIG. 4A, and when the functional circuit takes 3-bit data, three stages of flip-flop circuits are preferably used as illustrated in FIG. 4B. An OS transistor or a Si transistor is used as a transistor included in a flip-flop circuit included in the scan chain 55.

Figure 5:
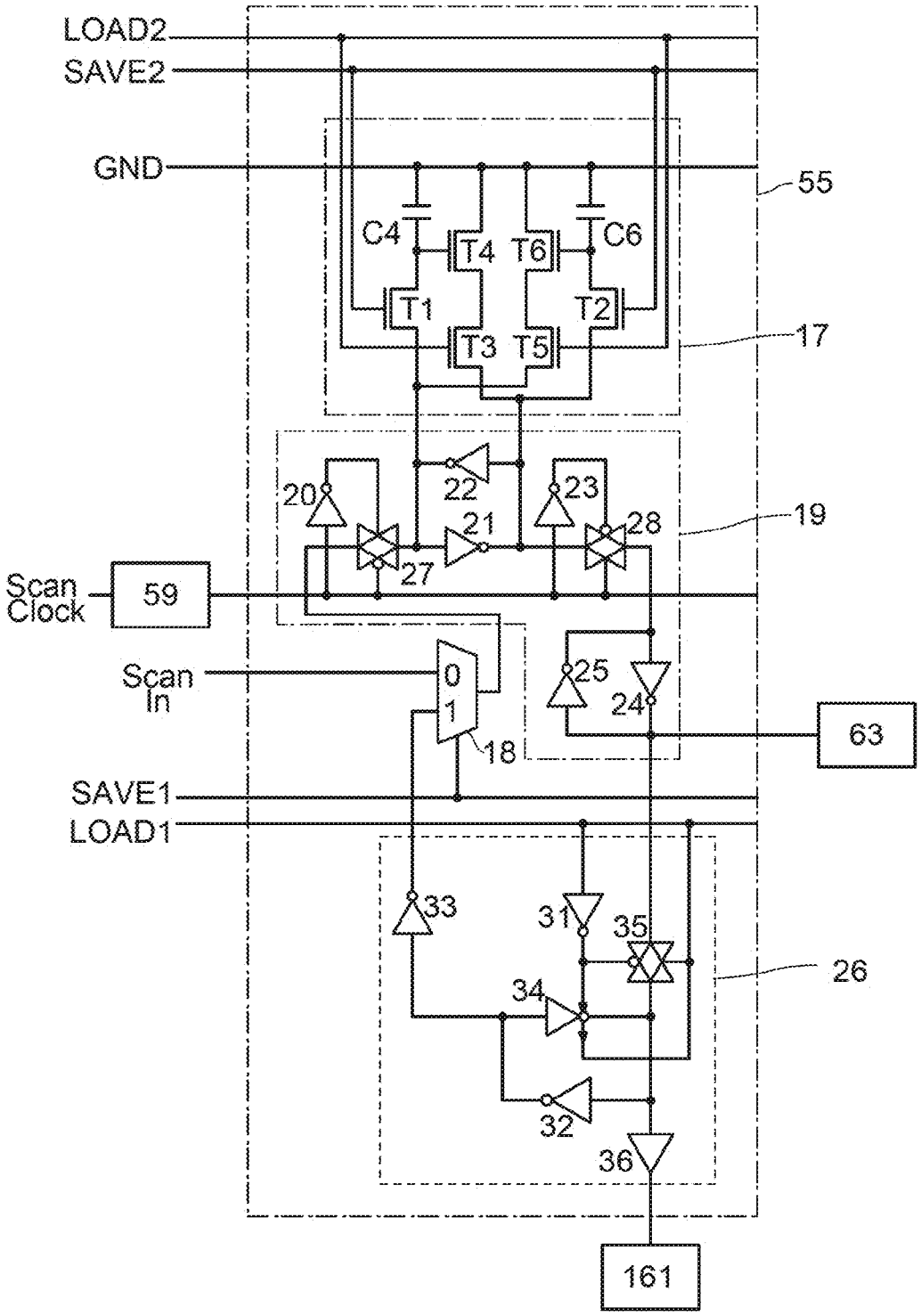
FIG. 5 illustrates a configuration of a scan chain.

The scan chain 55 in FIG. 5 includes a retention circuit 17, a selector 18, a flip-flop circuit 19 and a register 26. The scan chain 55 in FIG. 5 is illustrated as being provided with one stage of a flip-flop circuit; however, a plurality of stages may be provided depending on the data of the parameter taken by the corresponding functional circuit.

The retention circuit 17 includes transistors T1 to T6, and capacitors C4 and C6. The transistors T1, T3, and T4 and the capacitor C4 form a three-transistor type gain cell, and the transistors T2, T5, and T6 and the capacitor C6 form a three-transistor type gain cell. The retention circuit 17, in response to a signal SAVE2, stores complementary data stored in the flip-flop circuit 19 using the two gain cells, and in response to a signal LOAD2, loads the stored data to the flip-flop circuit 19.

One of two input terminals of the selector 18 is connected to the register 26, and the other of the two input terminals is connected to the input pin (Scan In). An output terminal of the selector 18 is connected to the flip-flop circuit 19.

The flip-flop circuit 19 includes inverters 20 to 25, and analog switches 27 and 28. An input terminal of the register 26 is connected to the data output terminal of the flip-flop circuit 19. Conduction of the analog switches 27 and 28 is controlled by the clock signal supplied through the AND circuit 59.

The register 26 includes inverters 31 to 33, a clocked inverter 34, an analog switch 35, and a buffer 36. The register 26, in response to a signal LOAD1, loads the data of the flip-flop circuit 19. The register 26 is a volatile register and is not limited to the circuit configuration illustrated in the drawing; the register 26 may be formed with known circuits such as a latch circuit, a flip-flop circuit, or the like.

A Si transistor or an OS transistor may be used as the transistor to form the retention circuit 17, the selector 18, the flip-flop circuit 19, and the register 26. Note that the OS transistor is preferably used as each of the transistors T1 and T2 included in the retention circuit 17. When the OS transistor is used as each of the transistors T1 and T2, the retention circuit 17 is able to store data for a long time even when power supply is shut down. Accordingly, a controller IC with further reduction in power consumption can be provided.

Next, the parameters stored in the functional circuits 161 to 164 are described with reference to FIGS. 21A and 21B.

Figure 21A:
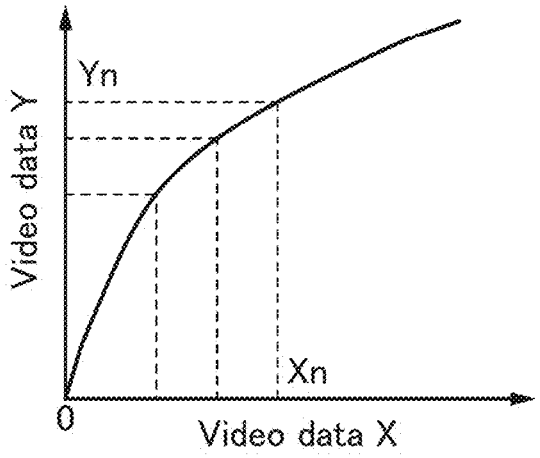
FIGS. 21A and 21B each show image data correction using a parameter.
Figure 21B:
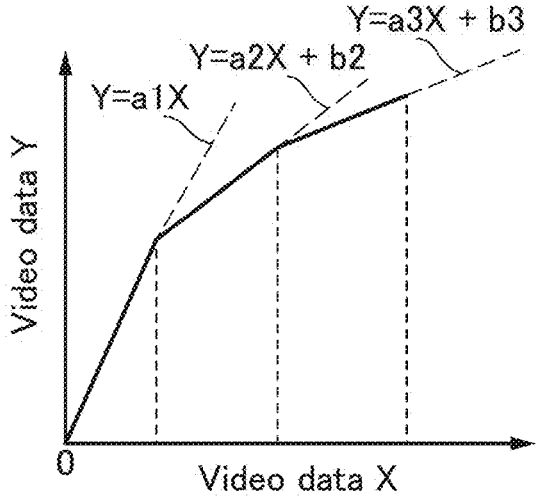

The parameters stored in the functional circuits 161 to 164 are parameters for converting the image data X1 to X4 (denoted as video data X in FIGS. 21A and 21B) to the corrected image data Y1 to Y4 (denoted as video data Y in FIGS. 21A and 21B). The parameters can be used for purposes such as color adjustment, dimming, gamma correction, OLED compensation, power saving setting (e.g., time before the display luminance is reduced, and time before the display is shut down), sensitivity of the touch sensor of the display device, a given user setting, or the like.

Methods to set the parameter include a table method and a function approximation method. The table method is a method in which image data Yn obtained by correcting image data Xn are stored in a table as parameters (see FIG. 21A). In the table method, registers corresponding to the table for storing parameters are needed in large numbers, but the range of possible corrections become wide. The function approximation method is preferably used when the image data Y corresponding to image data X can be determined beforehand from experience (see FIG. 21B). In FIG. 21B, a1, a2, b2, and the like amount to parameters. FIG. 21B shows a method in which linear approximation is performed in each section, but a method in which a non-linear function is used for approximation may be used as well. The function approximation method has a narrow range of possible corrections, but the number of registers for storing parameters that define the function can be small.

The functional circuits 161 to 164 each retain a parameter and have a function based on the content of the stored parameter; for example, the functional circuits 161 to 164 amount to a color adjustment circuit, a dimming circuit, a gamma correction circuit, and an OLED compensation circuit. The color adjustment circuit, in response to the color tone of the external light that is measured with an optical sensor, corrects image data using a parameter for adjusting the color tone of at least one of the reflective element and the light-emitting element. The dimming circuit, in response to the intensity of the external light that is measured with an optical sensor, corrects image data using a parameter for adjusting the reflection intensity of the reflective element and the emission intensity of the light-emitting element. The gamma correction circuit stores a parameter for gamma correction and performs gamma correction on image data using the parameter. The OLED compensation circuit adjusts the luminance of the light-emitting element based on information supplied from a current detection circuit (provided on the source driver) that detects current flowing through the light-emitting element.

Embodiment 2

In this embodiment, a display device in which the controller IC of the present invention is used and which includes a reflective element and a light-emitting element are included in one pixel is described with reference to FIGS. 6A and 6B, FIG. 7, and FIG. 8.

Figure 6A:
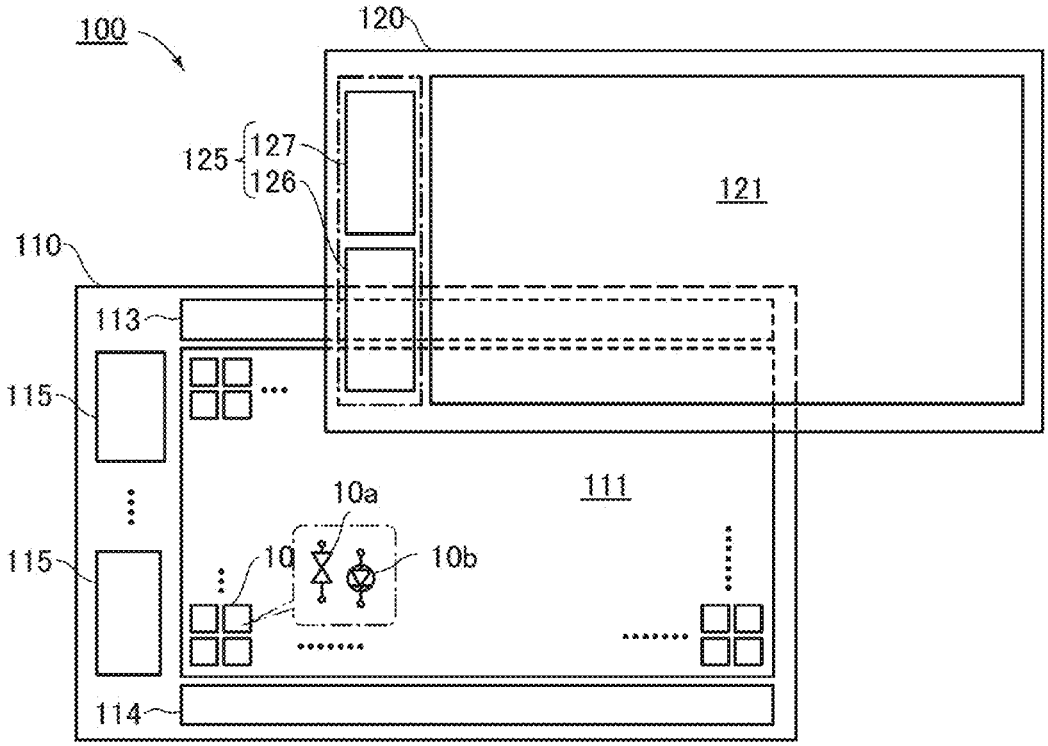
FIGS. 6A and 6B each illustrate a configuration of a display device.

A display device 100 includes a display unit 110 and a touch sensor unit 120 (see FIG. 6A). The display unit 110 includes a pixel array 111, gate drivers 113 and 114, and a controller IC 115.

The pixel array 111 includes pixels 10, and each pixel 10 includes a reflective element 10*a* and a light-emitting element 10*b*. The gate driver 113 has a function of driving the reflective element 10*a*, and the gate driver 114 has a function of driving the light-emitting element 10*b*. The controller IC 115 has a function of controlling the overall operation of the display device 100. The number of the controller ICs 115 is determined depending on the number of the pixels 10 in the pixel array.

The display device in FIG. 6A is an example in which the pixel array 111 and the gate drivers 113 and 114 are integrated on the same substrate; however, dedicated ICs may be used as the gate drivers 113 and 114. In addition, the gate drivers 113 and 114 can be integrated within the controller IC 115.

In addition, the display device in FIG. 6A illustrates an example in which a chip on glass (COG) method is used for implementation of the controller IC 115; however, methods such as a chip on flexible (COF) method or a tape automated bonding (TAB) method may be used. The same applies to the IC implementation method of the touch sensor unit 120.

A transistor containing an oxide semiconductor in a channel formation region is preferably used as a transistor in the pixel 10. The off-state current of the OS transistor can be made extremely low by reducing the concentration of impurities in an oxide semiconductor to make the oxide semiconductor intrinsic or substantially intrinsic.

Use of a transistor with low off-state current in the pixel 10 enables a temporary suspension of operation in the gate drivers 113 and 114 and the source driver when the display does not need to be rewritten (e.g., when the displayed image is a static image). This driving method may be hereinafter referred to as an idling-stop driving. The idling-stop driving can reduce power consumption of the display device 100.

The touch sensor unit 120 includes a sensor array 121 and a peripheral circuit 125. The peripheral circuit 125 includes a touch sensor driver (hereinafter referred to as a TS driver) 126 and a sensing circuit 127. The peripheral circuit 125 can be configured with a dedicated IC.

Figure 6B:
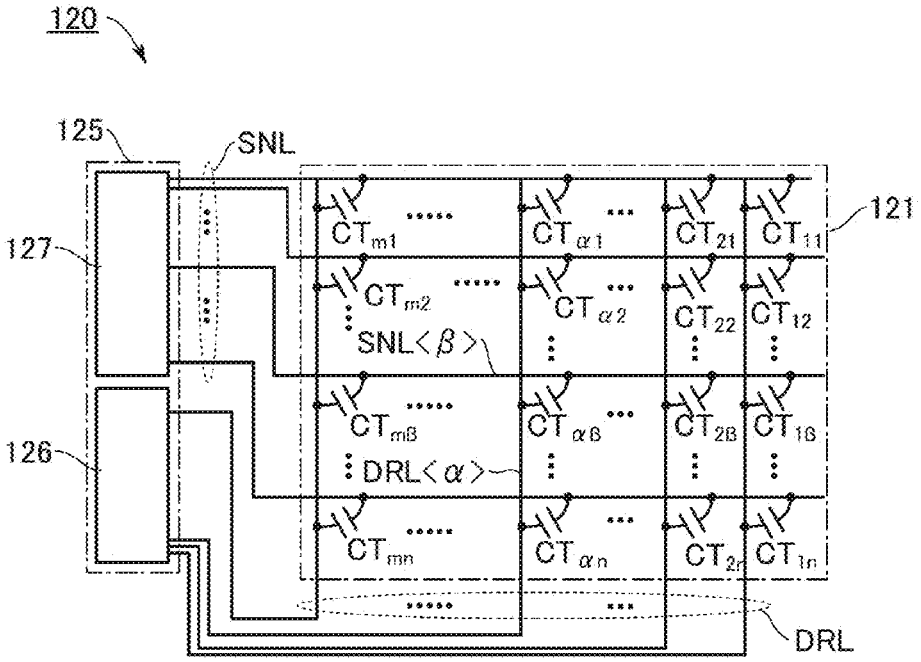

Next, as a specific example of the touch sensor unit 120, a case in which the touch sensor unit 120 is a mutual capacitive touch sensor unit is described (see FIG. 6B).

The sensor array 121 includes m wirings DRL and n wirings SNL (m and n are integers greater than or equal to 1). The wiring DRL is a driving line, and the wiring SNL is a sensing line. In the following description, the α-th wiring DRL is referred to as the wiring DRL<α>, and the β-th wiring SNL is referred to as the wiring SNL<β>. A capacitance $CT_{\alpha\beta}$ refers to a capacitance formed between the wiring DRL<α> and the wiring SNL<β>.

The m wirings DRL are connected to the TS driver 126. The TS driver 126 has a function of driving the wiring DRL. The n wirings SNL are connected to the sensing circuit 127. The sensing circuit 127 has a function of detecting signals in the wiring SNL. The signal in the wiring SNL<β>, during a period in which the wiring DRL<α> is being driven by the TS driver 126, includes information on the amount of change in the capacitance $CT_{\alpha\beta}$. By analyzing signals of the n wirings SNL, information on the presence or absence of touch, the touch position, and the like can be obtained.

Next, a configuration of the controller IC 115 is described with reference to the block diagram in FIG. 7. The controller IC 115 includes a clock generation circuit 155, a sensor controller 153, a controller 154, a decoder 152, a frame memory 151, a timing controller 173, a touch sensor controller 184, a source driver 180, the register 175, and the image processing portion 160. The controller IC 115 is connected to a host 140 and an optical sensor 143 that senses an external light 145.

The clock generation circuit 155 has a function of generating a clock signal to be used in the controller IC 115.

The sensor controller 153 is connected to the optical sensor 143. The optical sensor 143 has a function of sensing the external light 145 and generating a sensor signal. The sensor controller 153 has a function of generating a control signal on the basis of the sensor signal. The control signal generated in the sensor controller 153 is output to the controller 154.

The controller 154 has a function of processing a variety of control signals supplied from the host 140 through an interface 150 and controlling a variety of circuits in the controller IC 115. The controller 154 also has a function of controlling power supply to the variety of circuits in the controller IC 115.

The decoder 152 has a function of decompressing compressed image data. FIG. 7 illustrates a case in which the decoder 152 is positioned between the controller 154 and the image processing portion 160, but the decoder 152 may be positioned between the frame memory 151 and the interface 150.

The frame memory 151 has a function of storing the image data input to the controller IC 115. In the case where compressed image data is transmitted from the host 140, the frame memory 151 can store the compressed image data.

The timing controller 173 has a function of generating timing signals to be used in the source driver 180, the touch sensor controller 184, and the gate drivers 113 and 114 of the display unit 110.

The touch sensor controller 184 has a function of controlling the TS driver 126 and the sensing circuit 127 that are included in the touch sensor unit 120. A signal including touch information read by the sensing circuit 127 is processed in the touch sensor controller 184 and output to the host 140 through the interface 150. The host 140 generates image data reflecting the touch information and outputs the image data to the controller IC 115. Note that the touch information may be reflected in the image data within the controller IC 115, without the use of the host 140.

The source driver 180 includes a source driver 181 and a source driver 182. The source driver 181 has a function of driving the reflective element 10*a* (e.g., a liquid crystal (LC) element), and the source driver 182 has a function of driving the light-emitting element 10*b* (e.g., an electroluminescence (organic EL) element).

The host 140 has a function of communicating with the controller IC 115 through the interface 150. The host 140 supplies image data, a variety of control signals, and the like, to the controller IC 115. The controller IC 115 supplies information such as touch position obtained by the touch sensor controller 184 to the host 140. Note that each circuit included in the controller IC 115 can be provided or omitted as appropriate, depending on the standard of the host 140, the specifications of the display device 100, or the like.

The register 175 has a function of storing data used for the operation of the controller IC 115. The data stored in the register 175 includes a parameter used to perform correction process in the image processing portion 160, a parameter used to generate waveforms of a variety of timing signals in the timing controller 173, and the like. A configuration illustrated in FIG. 1 or FIG. 2 is applied to the register 175.

Figure 2:
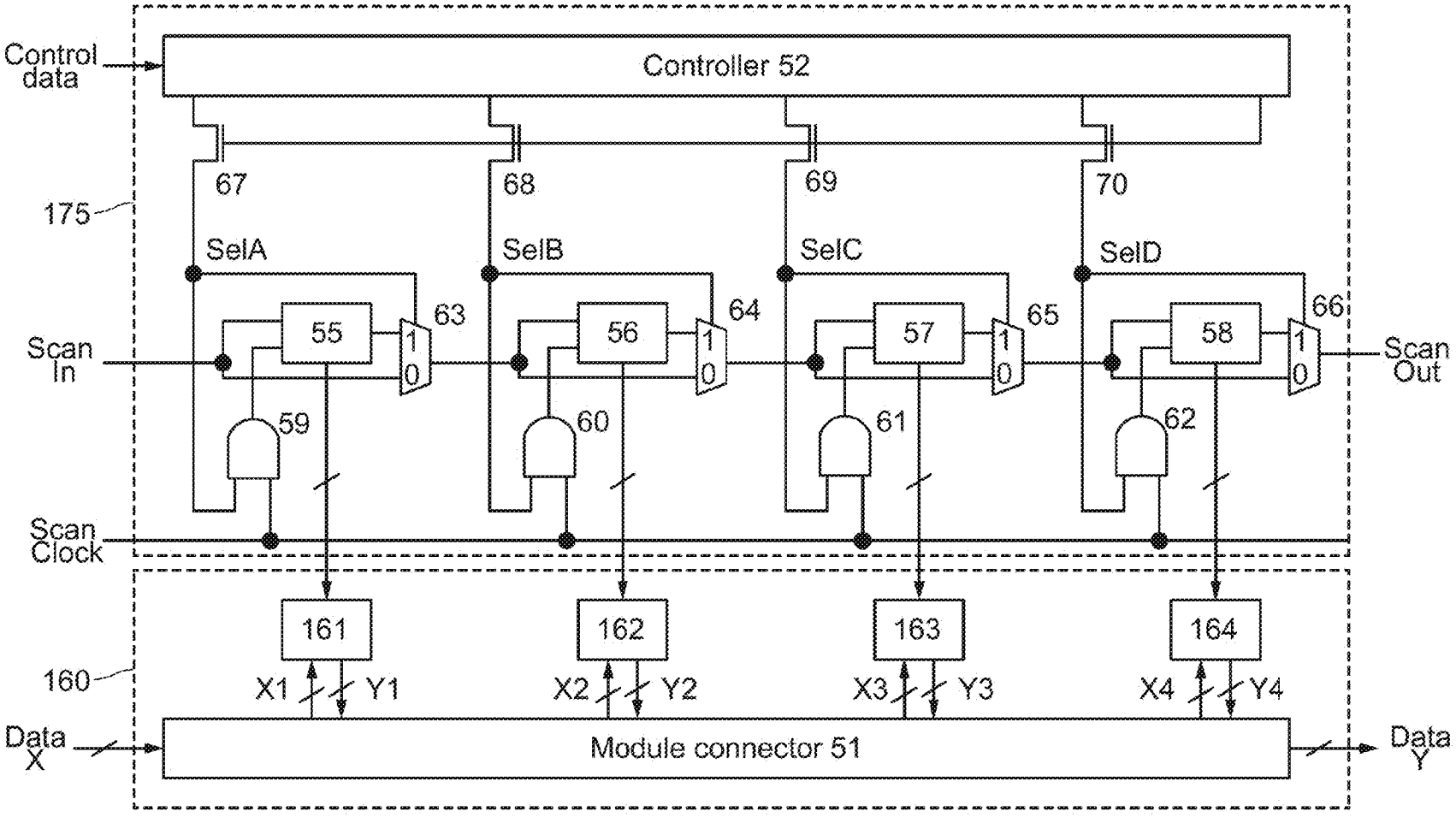
FIG. 2 illustrates a configuration of a controller IC.
Figure 3:
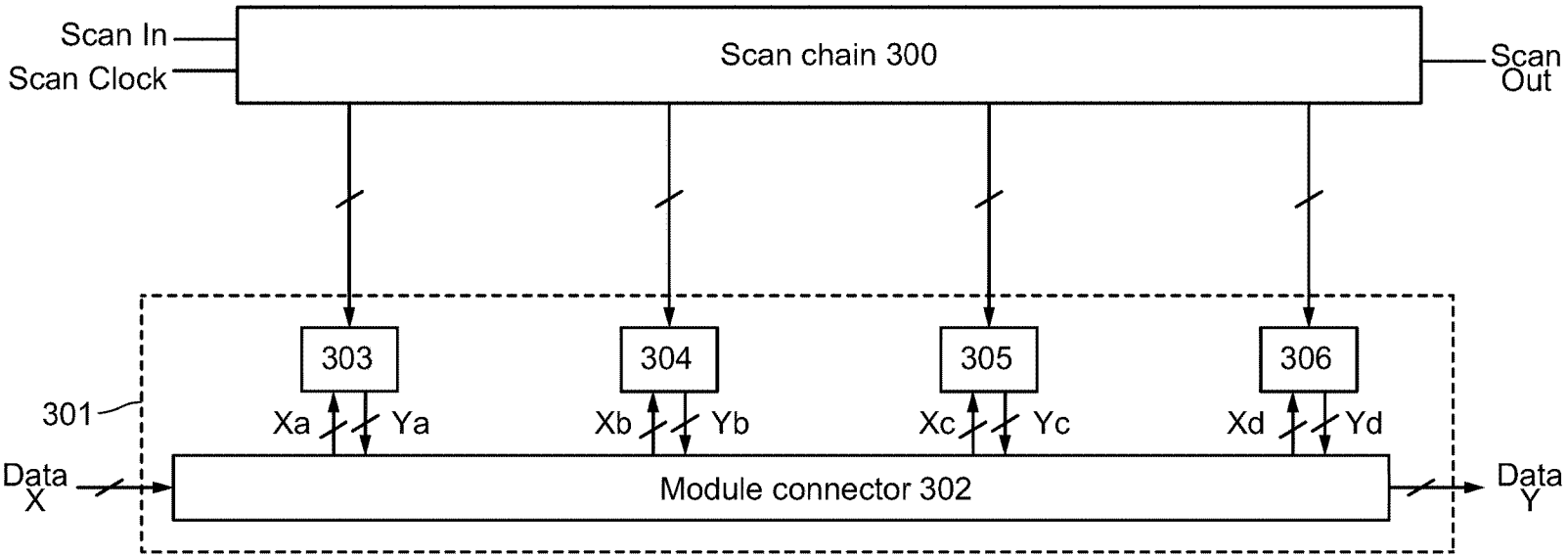
FIG. 3 Prior Art
FIG. 3 illustrates a configuration of a controller IC.

The image processing portion 160 includes the module connector 51 and the functional circuits 161 to 164, and the configuration illustrated in FIG. 1 or FIG. 2 is used in the image processing portion 160. The image processing portion 160 has a function of performing a variety of image processing on image data; specifically, in response to the brightness or the color tone of external light, the image processing portion 160 creates image data for displaying images only with the reflective element 10*a*, image data for displaying images only with the light-emitting element 10*b*, or image data for displaying images with both the reflective element 10*a* and the light-emitting element 10*b*. For example, when the display device 100 is used outside on a sunny day, sufficient luminance can be obtained with only the reflective element 10*a*. Accordingly, the light-emitting element 10*b* does not need to emit light in this case, and the image processing portion 160 creates the image data for displaying images only with the reflective element 10*a*. When the display device 100 is used at night or in a dark place, sufficient luminance cannot be obtained with the reflective element 10*a* alone; consequently, the image processing portion 160 creates the image data for displaying images with both the reflective element 10*a* and the light-emitting element 10*b*.

The image data processed in the image processing portion 160 is output to the source driver 180 through a memory 170 that temporarily stores the image data. The source driver 181 and the source driver 182 each have a function of processing the input image data and outputting the image data to the source line of the pixel array 111.

The functional circuits 161 to 164 each store a parameter. Here, the functional circuit 161, the functional circuit 162, the functional circuit 163 and the functional circuit 164 are a gamma correction circuit, a color adjustment circuit, a dimming circuit, and an OLED compensation circuit, respectively. The color adjustment circuit corrects image data using a parameter to adjust the color tone of at least one of the reflective element 10*a* and the light-emitting element 10*b*, in response to the color tone of the external light 145 measured with the optical sensor 143 and the sensor controller 153. For example, when the display device 100 is used in an environment with a reddish hue of sunset, an image display with only the reflective element 10*a* may result in insufficient blue component. In such a case, the image data may be corrected so that a blue light-emitting element 10*b* emits light thereby correcting the color tone. The dimming circuit corrects image data using a parameter to adjust the reflection intensity of the reflective element 10*a* and the emission intensity of the light-emitting element 10*b*, in response to the brightness of the external light 145 measured with the optical sensor 143 and the sensor controller 153. The OLED compensation circuit has a function of adjusting the luminance of the light-emitting element 10*b* on the basis of the information supplied from the current detection circuit provided on the source driver 182 that detects current that flows in the light-emitting element 10*b*.

The image processing portion 160 may include another processing circuit such as an RGB-RGBW conversion circuit depending on the specifications of the display device 100. The RGB-RGBW conversion circuit has a function of converting image data of red, green, and blue (RGB) into image signals of red, green, blue, and white (RGBW). That is, when the display device 100 includes pixels of four colors of RGBW, power consumption can be reduced by displaying a white (W) component in the image data using the white (W) pixel. Note that the image processing portion 160 may include not the RGB-RGBW conversion circuit, but an RGB-RGBY (red, green, blue, and yellow) conversion circuit, for example.

In addition, the image processing portion 160 may output image data for the reflective element 10*a* and the light-emitting element 10*b* to display different images. In general, operation speed of a liquid crystal, an electronic paper, or the like that can be used as a reflective element is low in many cases, thereby requiring some time before an image is displayed. Accordingly, the reflective element 10*a* may display a still image that serves as a background, and the light-emitting element 10*b* may display a mouse pointer or the like that has motion. The display device 100 can achieve both smooth display of moving images and low power consumption by performing idling-stop driving on still images and emitting light from the light-emitting element 10*b* for moving images. In this case, the frame memory 151 may be provided with regions for storing image data to be displayed on the reflective element 10*a* and image data to be displayed on the light-emitting element 10*b*.

In the case where image data transmitted from the host 140 is not changed, the controller 154 can power gate some circuits in the controller IC 115. The circuits include, for example, circuits within a region 190 (the frame memory 151, the decoder 152, the image processing portion 160, the memory 170, the timing controller 173, the register 175, and the source driver 180). The power gating may be performed when the host 140 sends a control signal that indicates there is no change in the image data to the controller IC 115 and the control signal is detected by the controller 154.

The circuits in the region 190 are circuits pertaining to image data and the circuits for driving the display unit 110; therefore, the circuits in the region 190 can be temporarily stopped in the case where the image data is not changed. Note that even when the image data is not changed, time during which the transistor used for the pixel 10 can store data (time during which idling stop can be performed) and time during which inversion driving is performed to prevent burn-in of a liquid crystal element used as the reflective element 10*a* may be considered. When the time is considered, for example, a timer function may be incorporated into the controller 154 so as to determine timing at which power supply to the circuits in the region 190 is restarted, based on time measured by a timer.

Note that image data may be stored in the frame memory 151 or the memory 170 in advance and the image data may be supplied to the display unit 110 at inversion driving. With such a configuration, inversion driving can be performed without transmitting the image data from the host 140. Thus, the amount of data transmitted from the host 140 can be reduced and power consumption of the controller IC 115 can be reduced.

Figure 7:
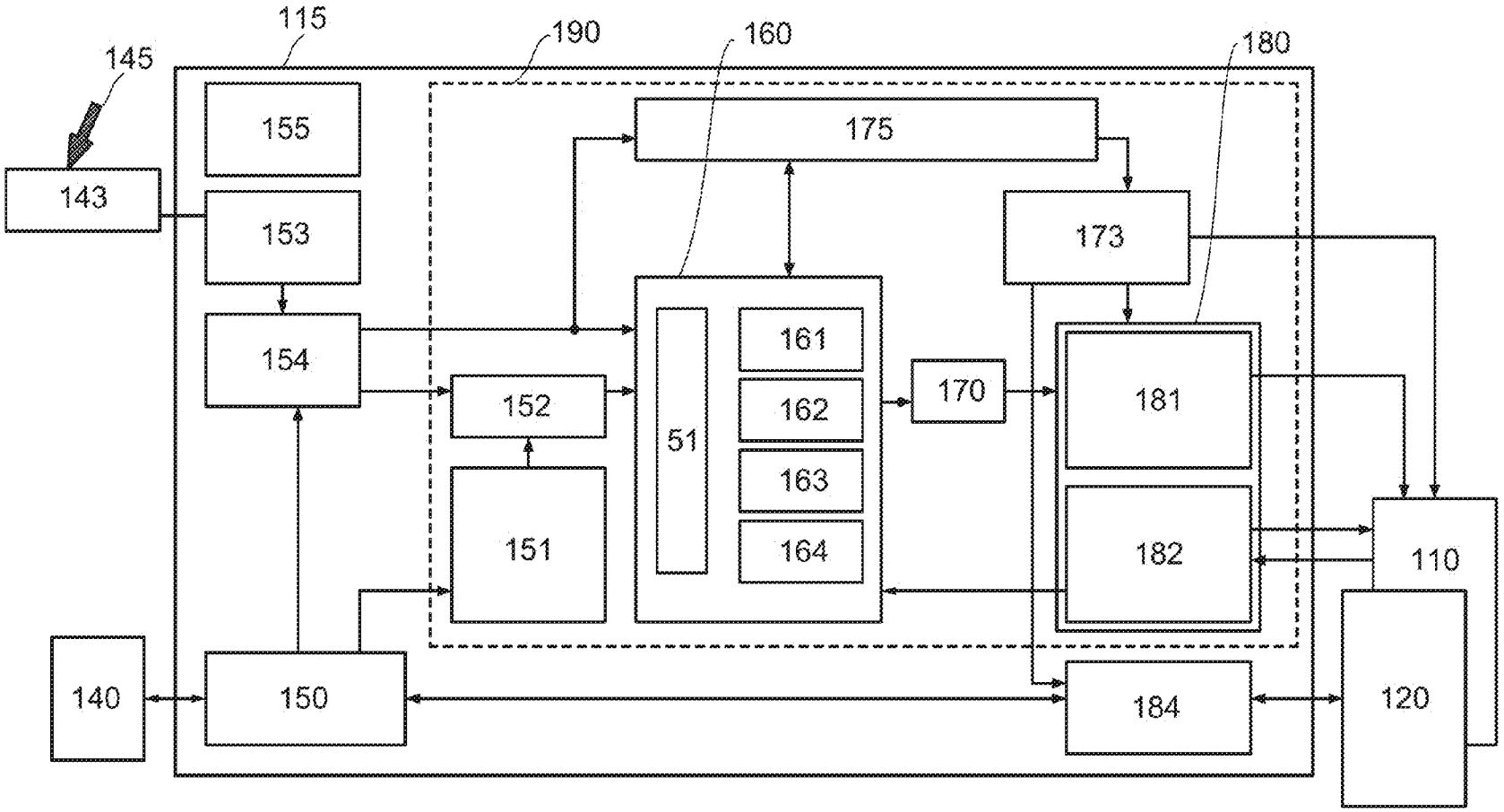
FIG. 7 is a block diagram illustrating a configuration example of a controller IC.
Figure 8:
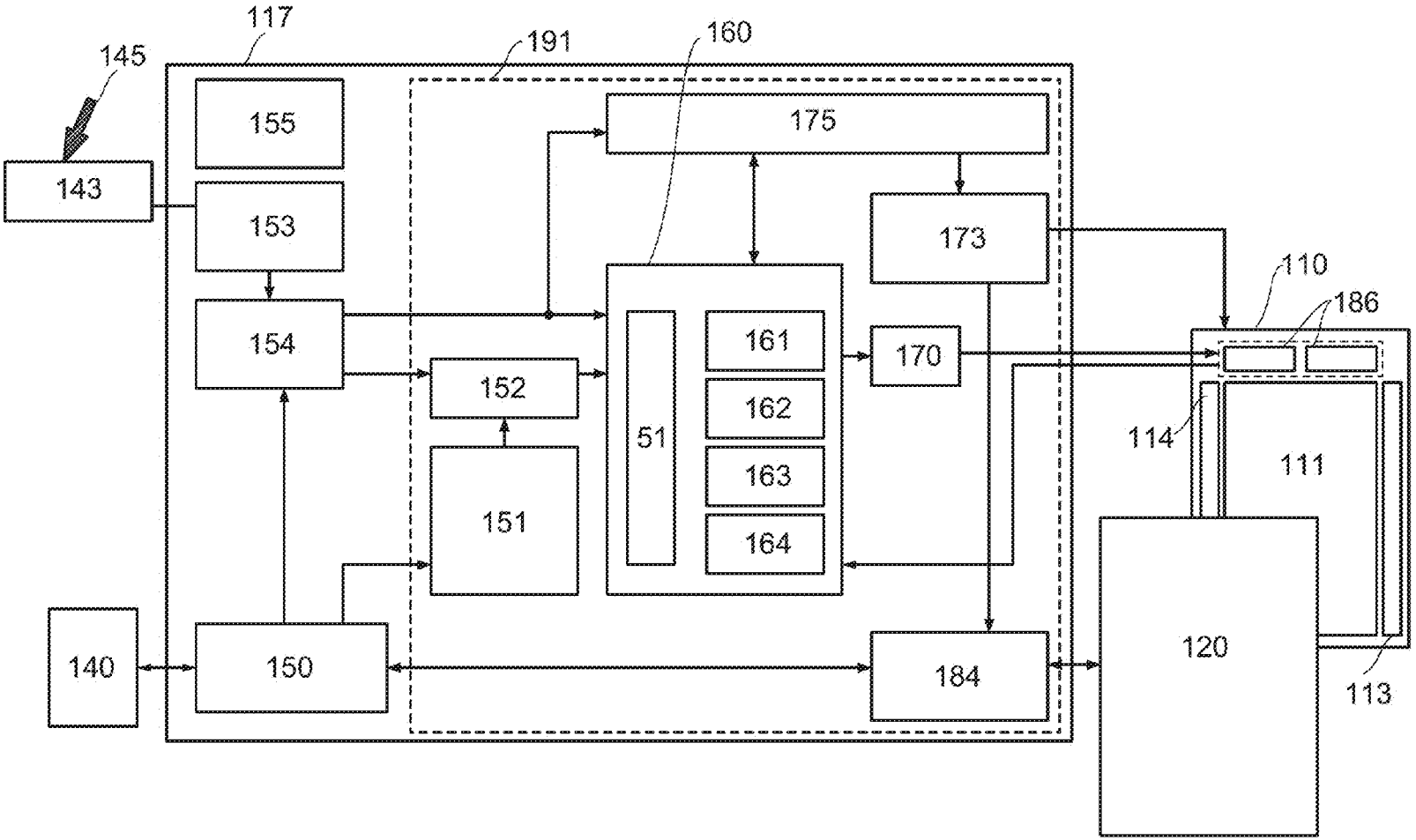
FIG. 8 is a block diagram illustrating a configuration example of a controller IC.

Next, a controller IC with a configuration different from that in FIG. 7 is described with reference to FIG. 8. The controller IC in FIG. 8 is different from that in FIG. 7 in that the controller IC does not include a source driver. The controller IC 117 in FIG. 8 is a modification example of the controller IC 115 and includes a region 191. The controller 154 controls power supply to circuits in the region 191.

A source driver is provided not in the region 191 but in the display unit 110, as a source driver IC 186. The number of the source driver ICs 186 is determined in response to the number of pixels in the pixel array 111.

The source driver IC 186 has a function of driving both the reflective element 10*a* and the light-emitting element 10*b*. Although the source driver is formed using only one type of source driver IC 186, the configuration of the source driver is not limited thereto. For example, the source driver may be formed using a source driver IC for driving the reflective element 10*a* and a source driver IC for driving the light-emitting element 10*b*.

Similar to the gate driver 113 and the gate driver 114, the source drivers may be formed over a substrate of the pixel array 111.

Embodiment 3

Figure 9:
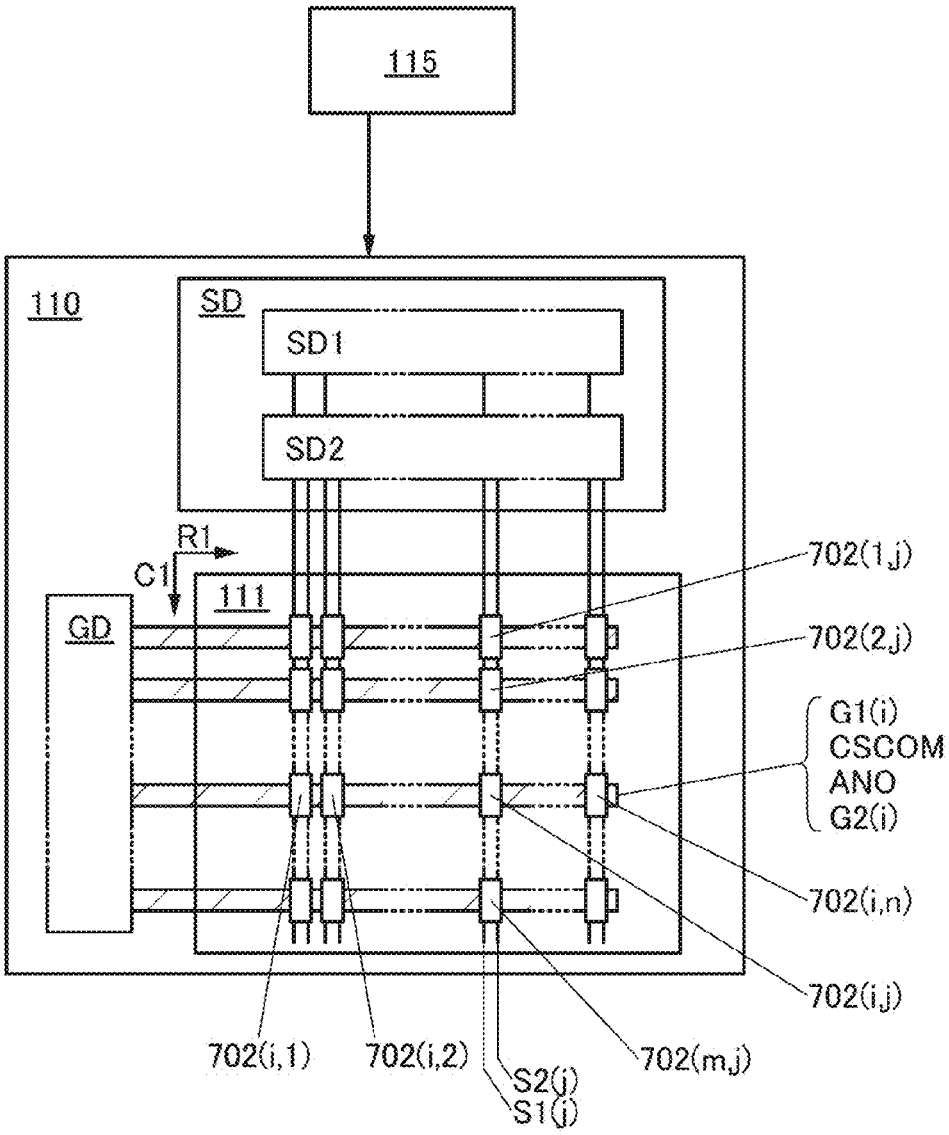
FIG. 9 is a block diagram illustrating a configuration example of a display unit.

A specific configuration of the display unit 110 is described with reference to FIG. 9, FIG. 10, FIGS. 11A and 11B, FIGS. 12A and 12B, FIGS. 13A and 13B, FIGS. 14A, 14B, and 14C, and FIGS. 15A and 15B. The display unit 110 includes the pixel array 111, a gate driver GD and a source driver SD (see FIG. 9).

The pixel array 111 includes one group of pixels 702(*i*, 1) to 702(*i, n*), another group of pixels 702(1, *j*) to 702(*m, j*), a scan line G1(*i*), a scan line G2(*i*), a wiring CSCOM, a wiring ANO, and a signal line S2(*j*). Note that i is an integer greater than or equal to 1 and less than or equal to m, j is an integer greater than or equal to 1 and less than or equal to n, and each of m and n is an integer greater than or equal to 1.

The one group of pixels 702(*i*, 1) to 702(*i, n*) include a pixel 702(*i,j*) and are provided in the row direction (the direction indicated by the arrow R1 in the drawing). The another group of pixels 702(1, *j*) to 702(*m, j*) include the pixel 702(*i, j*) and are provided in the column direction (the direction indicated by the arrow C1 in the drawing) that intersects the row direction.

The scan line G1(*i*) and the scan line G2(*i*) are connected to the one group of pixels 702(*i*, 1) to 702(*i, n*) provided in the row direction. A signal line S1(*j*) and the signal line S2(*j*) are connected to the another group of the pixels 702(1, *j*) to 702(*m, j*) provided in the column direction.

The gate driver GD has a function of supplying a selection signal to the pixel array 111 in response to control information. For example, the gate driver GD has a function of supplying a selection signal to one scan line at a frequency of 30 Hz or higher, preferably 60 Hz or higher, in response to the control information. This function allows a smooth display of moving images. In addition, the gate driver GD has a function of supplying a selection signal to one scan line at a frequency of lower than 30 Hz, preferably lower than 1 Hz, more preferably less than once per minute, in response to the control information. This function allows a display of a still image with little flickering.

The source driver SD includes a source driver SD1 and a source driver SD2. Each of the source driver SD1 and the source driver SD2 has a function of supplying a data signal to the pixel array 111 in response to a signal from the controller IC 115.

The source driver SD1 has a function of generating a data signal which is to be supplied to a pixel circuit connected to a display element. Specifically, the source driver SD1 has a function of generating a signal whose polarity is inverted. With this function, a liquid crystal display element can be driven, for example. The source driver SD2 has a function of generating a data signal that is supplied to a pixel circuit connected to another display element which displays an image by a method different from that of the above-mentioned display element. With this function, an organic EL element can be driven, for example.

Any of a variety of sequential circuits, such as a shift register, can be used in the source driver SD. In addition, an integrated circuit in which the source driver SD1 and the source driver SD2 are integrated can be used as the source driver SD. Furthermore, the source driver SD may be provided in the integrated circuit including the controller IC 115. Specifically, an integrated circuit formed over a silicon substrate can be used for the controller IC 115 and the source driver SD.

Figure 10:
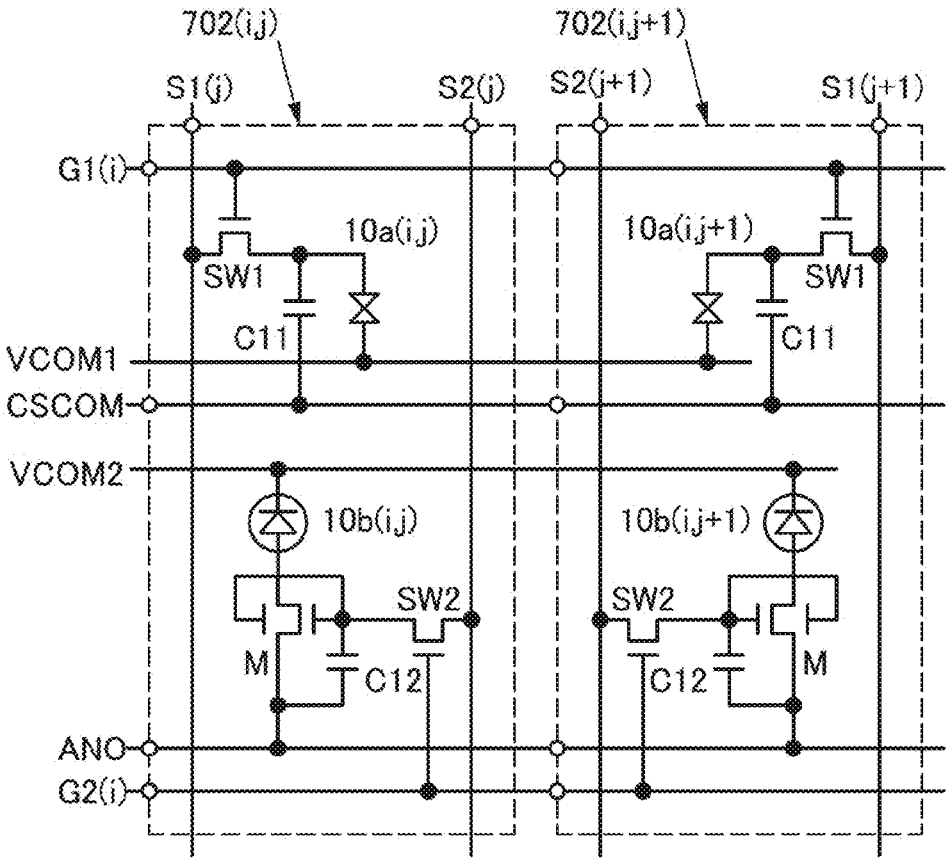
FIG. 10 is a circuit diagram illustrating a configuration example of a pixel.

The pixel 702(*i,j*) includes a reflective element 10*a*(*i, j*) and a light-emitting element 10*b*(*i, j*) (see FIG. 10). Using the reflective element 10*a* to display images can reduce power consumption. In addition, an image can be favorably displayed with high contrast in an environment with bright external light. With the use of the light-emitting element 10*b*, which emits light, images can be favorably displayed in a dark environment.

The pixel 701(*i,j*) includes a switch SW1, a capacitor C11, a switch SW2, a transistor M and a capacitor C12, and is connected to the signal line S1(*j*), the signal line S2(*j*), the scan line G1(*i*), the scan line G2(*i*), the wiring CSCOM, and the wiring ANO.

As a switch SW1, a transistor including a gate electrode connected to the scan line G1(*i*) and a first electrode connected to the signal line S1(*j*) may be used. The capacitor C11 includes a first electrode connected to a second electrode of the transistor used as the switch SW1 and a second electrode connected to the wiring CSCOM.

As the switch SW2, a transistor including a gate electrode connected to the scan line G2(*i*) and a first electrode connected to the signal line S2(*j*) may be used. The transistor M includes a gate electrode connected to a second electrode of the transistor used as the switch SW2 and a first electrode connected to the wiring ANO. Note that the transistor M may include a first gate electrode and a second gate electrode, and the first gate electrode and the second gate electrode may be connected. The first gate electrode and the second gate electrode include regions overlapping with each other with a semiconductor film provided therebetween. The capacitor C12 includes a first electrode connected to a second electrode of the transistor used as the switch SW2 and a second electrode connected to the first electrode of the transistor M.

A first electrode of the reflective element 10*a*(*i, j*) is connected to the second electrode of the transistor used as the switch SW1. A second electrode of the reflective element 10*a*(*i, j*) is connected to a wiring VCOM1. A first electrode of the light-emitting element 10*b*(*i, j*) is connected to a second electrode of the transistor M. A second electrode of the light-emitting element 10*b*(*i, j*) is connected to a wiring VCOM2.

Figure 11A:
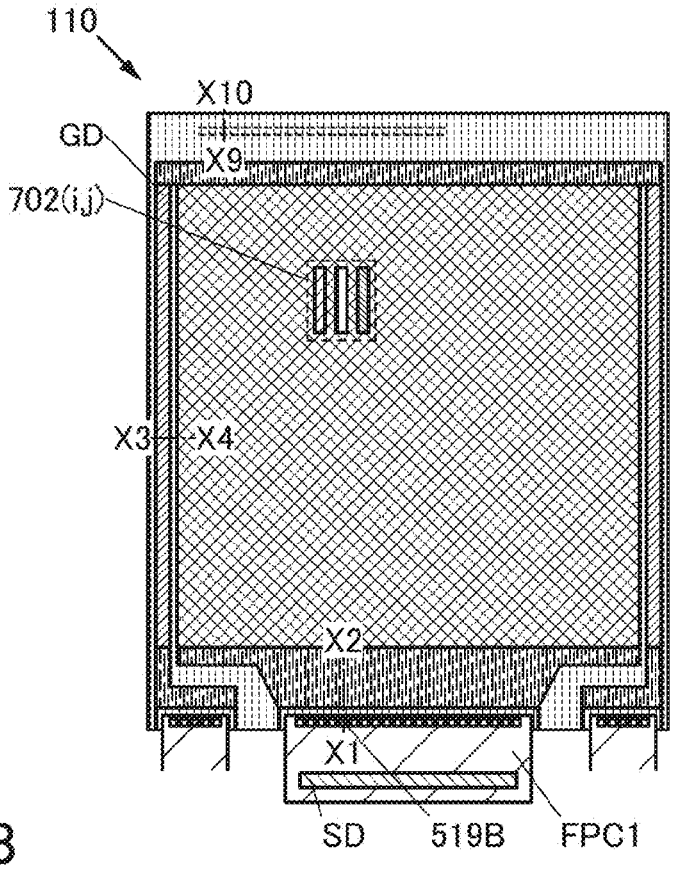
FIG. 11A is a top view illustrating a configuration example of a display unit.
Figure 11B:
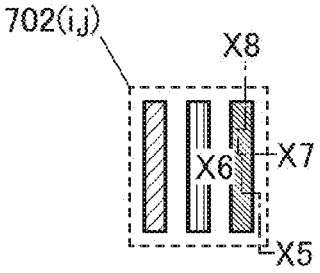
FIGS. 11B and 11C are each a top view illustrating a configuration example of a pixel.
Figure 11C:
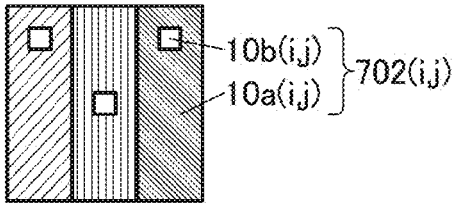

Next, a top-view structure of the display unit 110 is described with reference to FIGS. 11A, 11B, and 11C. FIG. 11A is a top view of the display unit 110. FIG. 11B is a top view illustrating one pixel of the display unit 110 illustrated in FIG. 11A. FIG. 11C is a schematic view illustrating the configuration of the pixel illustrated in FIG. 11B.

The display unit 110 has a structure in which the source driver SD and the terminal 519B are provided over the flexible printed circuit FPC1 (see FIG. 11A). The pixel 702(*i,j*) includes a reflective element 10*a*(*i, j*) and a light-emitting element 10*b*(*i, j*) (see FIG. 11C).

Figure 12A:
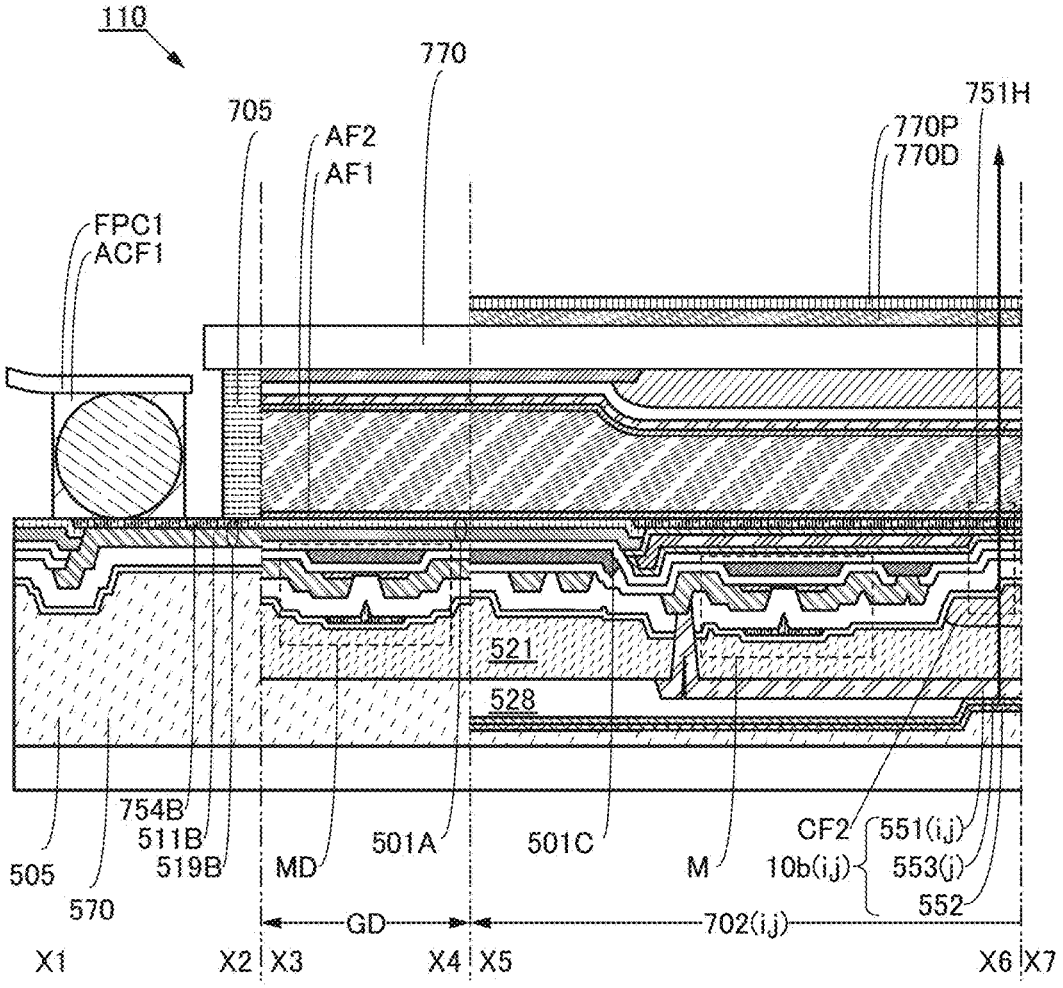
FIGS. 12A and 12B are each a cross-sectional view illustrating a configuration example of a display unit.
Figure 12B:
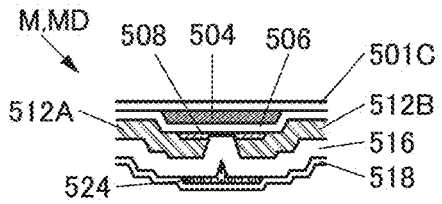
Figure 13A:
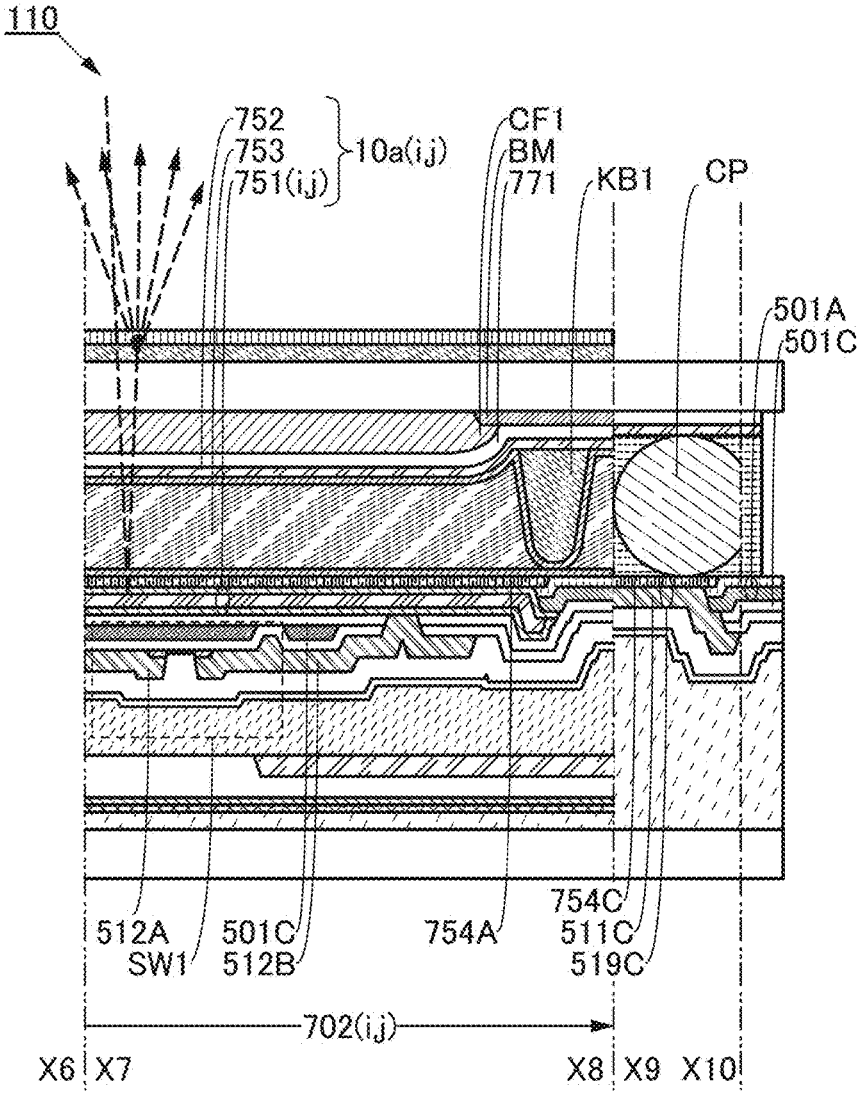
FIGS. 13A and 13B are each a cross-sectional view illustrating a configuration example of a display unit.
Figure 13B:
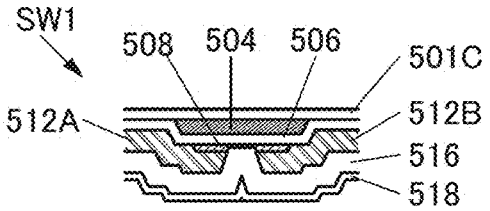

Next, components of the display unit 110 and a cross-sectional structure of the display unit 110 are described with reference to FIGS. 12A and 12B, and FIGS. 13A and 13B. FIG. 12A is a cross-sectional view taken along lines X1-X2, X3-X4, and X5-X6 in FIG. 11A. FIG. 12B illustrates part of FIG. 12A. FIG. 13A is a cross-sectional view taken along lines X7-X8 and X9-X10 in FIG. 11B. FIG. 13B illustrates part of FIG. 13A.

For a substrate 570, a material having heat resistance adequate to withstand heat treatment in the manufacturing process can be used. For example, a material with a thickness greater than or equal to 0.1 mm and less than or equal to 0.7 mm can be used for the substrate 570. Specifically, a material polished to a thickness of approximately 0.1 mm can be used.

For example, a large-sized glass substrate having any of the following sizes can be used as the substrate 570 or the like: the 6th generation (1500 mm×1850 mm), the 7th generation (1870 mm×2200 mm), the 8th generation (2200 mm×2400 mm), the 9th generation (2400 mm×2800 mm), and the 10th generation (2950 mm×3400 mm). Thus, a large-sized display device can be manufactured.

For the substrate 570 or the like, an organic material, an inorganic material, a composite material of an organic material and an inorganic material, or the like can be used. For example, an inorganic material such as glass, ceramic, or metal can be used for the substrate 570 or the like. Specifically, non-alkali glass, soda-lime glass, potash glass, crystal glass, aluminosilicate glass, tempered glass, chemically tempered glass, quartz, sapphire, or the like can be used for the substrate 570 or the like. Specifically, an inorganic oxide film, an inorganic nitride film, an inorganic oxynitride film, or the like can be used for the substrate 570 or the like. For example, a silicon oxide film, a silicon nitride film, a silicon oxynitride film, an aluminum oxide film, or the like can be used for the substrate 570 or the like. Stainless steel, aluminum, or the like can be used for the substrate 570 or the like.

For example, a single crystal semiconductor substrate or a polycrystalline semiconductor substrate of silicon or silicon carbide, a compound semiconductor substrate of silicon germanium or the like, or an SOI substrate can be used as the substrate 570 or the like. Thus, a semiconductor element can be provided over the substrate 570 or the like.

For example, an organic material such as a resin, a resin film, or plastic can be used for the substrate 570 or the like. Specifically, a resin film or resin plate of polyester, polyolefin, polyamide, polyimide, polycarbonate, an acrylic resin, or the like can be used for the substrate 570 or the like.

For example, a composite material formed by attaching a metal plate, a thin glass plate, or a film of an inorganic material to a resin film or the like can be used for the substrate 570 or the like. For example, a composite material formed by dispersing a fibrous or particulate metal, glass, inorganic material, or the like into a resin film can be used for the substrate 570 or the like. For example, a composite material formed by dispersing a fibrous or particulate resin, organic material, or the like into an inorganic material can be used for the substrate 570 or the like.

Furthermore, a single-layer material or a layered material in which a plurality of layers are stacked can be used for the substrate 570 or the like. For example, a layered material in which a base, an insulating film that prevents diffusion of impurities contained in the base, and the like are stacked can be used for the substrate 570 or the like. Specifically, a layered material in which glass and one or a plurality of films that are selected from a silicon oxide layer, a silicon nitride layer, a silicon oxynitride layer, and the like and that prevent diffusion of impurities contained in the glass are stacked can be used for the substrate 570 or the like. Alternatively, a layered material in which a resin and a film for preventing diffusion of impurities that penetrate the resin, such as a silicon oxide film, a silicon nitride film, and a silicon oxynitride film are stacked can be used for the substrate 570 or the like.

Specifically, a resin film, a resin plate, a stacked-layer material, or the like containing polyester, polyolefin, polyamide, polyimide, polycarbonate, an acrylic resin, or the like can be used as the substrate 570 or the like. In addition, specifically, a material including polyester, polyolefin, polyamide (e.g., nylon and aramid), polyimide, polycarbonate, polyurethane, an acrylic resin, an epoxy resin, a resin having a siloxane bond, such as silicone, or the like can be used for the substrate 570 or the like. Furthermore, specifically, polyethylene terephthalate (PET), polyethylene naphthalate (PEN), polyethersulfone (PES), acrylic, or the like can be used for the substrate 570 or the like. Alternatively, a cyclo olefin polymer (COP), a cyclo olefin copolymer (COC), or the like can be used. Alternatively, paper, wood, or the like can be used for the substrate 570 or the like. For example, a flexible substrate can be used as the substrate 570 or the like.

Note that a transistor, a capacitor, or the like can be directly formed on the substrate. Alternatively, a transistor, a capacitor, or the like formed on a substrate for use in manufacturing processes which can withstand heat applied in the manufacturing process can be transferred to the substrate 570 or the like. Thus, a transistor, a capacitor, or the like can be formed over a flexible substrate, for example.

Specifically, any of the materials that can be used for the substrate 570 can be used for the substrate 770. Specifically, any of the materials that can be used for the substrate 570 can be used for the substrate 770. For example, aluminosilicate glass, tempered glass, chemically tempered glass, sapphire, or the like can be favorably used for the substrate 770 that is on a side closer to a user of the display panel. This can prevent breakage or damage of the display panel caused by the use. A material with a thickness greater than or equal to 0.1 mm and less than or equal to 0.7 mm can be also used for the substrate 770, for example. Specifically, a substrate polished for reducing the thickness can be used. Thus, a functional film 770D can be provided so as to be close to the reflective element 10*a*(*i, j*). As a result, image blur can be reduced and an image can be displayed clearly.

For a structure body KB1, an organic material, an inorganic material, or a composite material of an organic material and an inorganic material can be used. Accordingly, a predetermined space can be provided between components between which the structure KB1 and the like are provided. Specifically, polyester, polyolefin, polyamide, polyimide, polycarbonate, polysiloxane, an acrylic resin, or the like, or a composite material of a plurality of resins selected from these can be used for the structure KB1. Alternatively, a photosensitive material may be used.

For the sealant 705, an inorganic material, an organic material, a composite material of an inorganic material and an organic material, or the like can be used. For example, an organic material such as a thermally fusible resin or a curable resin can be used for the sealant 705 or the like. For example, an organic material, such as a reactive curable adhesive, a photo-curable adhesive, a thermosetting adhesive, and/or an anaerobic adhesive, can be used for the sealant 705 or the like. Specifically, an adhesive containing an epoxy resin, an acrylic resin, a silicone resin, a phenol resin, a polyimide resin, an imide resin, a polyvinyl chloride (PVC) resin, a polyvinyl butyral (PVB) resin, an ethylene vinyl acetate (EVA) resin, or the like can be used for the sealant 705 or the like.

For a bonding layer 505, a material which can be used for the sealant 705 can be used.

For insulating films 518 and 521, an insulating inorganic material, an insulating organic material, or an insulating composite material containing an inorganic material and an organic material can be used. Specifically, for example, an inorganic oxide film, an inorganic nitride film, an inorganic oxynitride film, or a material obtained by stacking any of these films and the like can be used as the insulating film 521 or the like. For example, a film including any of a silicon oxide film, a silicon nitride film, a silicon oxynitride film, and an aluminum oxide film, and the like, or a film including a layered material obtained by stacking any of these films can be used for the insulating film 521 or the like. Specifically, polyester, polyolefin, polyamide, polyimide, polycarbonate, polysiloxane, an acrylic resin, or the like, or a composite material of a plurality of resins selected from these can be used for the insulating film 521 or the like. Alternatively, a photosensitive material may be used. Thus, steps due to various components overlapping with the insulating film 521, for example, can be reduced.

For the insulating film 528, a material which can be used for the insulating film 521 can be used. Specifically, a film containing polyimide with a thickness of 1 can be used as the insulating film 528.

For the insulating film 501A, a material which can be used for the insulating film 521 can be used. For example, a material having a function of supplying hydrogen can be used for the insulating film 501A. Specifically, a material in which a material containing silicon and oxygen and a material containing silicon and nitrogen are stacked can be used for the insulating film 501A. For example, a material having a function of releasing hydrogen by heating or the like to supply the hydrogen to another component can be used for the insulating film 501A. Specifically, a material having a function of releasing hydrogen taken in the manufacturing process, by heating or the like, to supply the hydrogen to another component can be used for the insulating film 501A. For example, a film containing silicon and oxygen that is formed by a chemical vapor deposition method using silane or the like as a source gas can be used as the insulating film 501A. Specifically, a material obtained by stacking a material containing silicon and oxygen and having a thickness greater than or equal to 200 nm and less than or equal to 600 nm and a material containing silicon and nitrogen and having a thickness of approximately 200 nm can be used for the insulating film 501A.

For the insulating film 501C, a material which can be used for the insulating film 521 can be used. Specifically, a material containing silicon and oxygen can be used for the insulating film 501C. Thus, diffusion of impurities into the pixel circuit, the second display element, or the like can be inhibited. For example, a 200-nm-thick film containing silicon, oxygen, and nitrogen can be used as the insulating film 501C.

For example, a film with a thickness greater than or equal to 10 nm and less than or equal to 500 nm, preferably greater than or equal to 10 nm and less than or equal to 100 nm can be used as the intermediate film 754A, the intermediate film 754B, or the intermediate film 754C. For example, a material having a function of allowing the passage of hydrogen or the supply of hydrogen can be used for the intermediate films 754A to 754C. In addition, for example, a conductive material can be used for the intermediate films 754A and 754C. Furthermore, for example, a light-transmitting material can be used for the intermediate films 754A to 754C.

Specifically, a material containing indium and oxygen, a material containing indium, gallium, zinc, and oxygen, a material containing indium, tin, and oxygen, or the like can be used for the intermediate film. Note that these materials have a function of allowing hydrogen passage. More specifically, a 50- or 100-nm-thick film containing indium, gallium, zinc, and oxygen can be used as the intermediate film. Note that a material in which films serving as etching stoppers are stacked can be used for the intermediate film. Specifically, a material obtained by stacking a 50-nm-thick film containing indium, gallium, zinc, and oxygen and a 20-nm-thick film containing indium, tin, and oxygen, in this order, can be used for the intermediate film.

A conductive material can be used for a wiring, a terminal, or a conductive film. Specifically, the conductive material can be used for the signal line S1(*j*), the signal line S2(*j*), the scan line G1(*i*), the scan line G2(*i*), the wiring CSCOM, the wiring ANO, the terminal 519B, the terminal 519C, the conductive film 511B, or the conductive film 511C.

For example, an inorganic conductive material, an organic conductive material, a metal, conductive ceramics, or the like can be used for the wiring or the like. Specifically, a metal element selected from aluminum, gold, platinum, silver, copper, chromium, tantalum, titanium, molybdenum, tungsten, nickel, iron, cobalt, palladium, and manganese, or the like can be used for the wiring or the like. Alternatively, an alloy including any of the above-described metal elements, or the like can be used for the wiring or the like. In particular, an alloy of copper and manganese is suitably used in microfabrication with the use of a wet etching method.

Specifically, any of the following structures can be used for the wiring or the like: a two-layer structure in which a titanium film is stacked over an aluminum film, a two-layer structure in which a titanium film is stacked over a titanium nitride film, a two-layer structure in which a tungsten film is stacked over a titanium nitride film, a two-layer structure in which a tungsten film is stacked over a tantalum nitride film or a tungsten nitride film, a three-layer structure in which a titanium film, an aluminum film, and a titanium film are stacked in this order, and the like. In addition, specifically, a conductive oxide, such as indium oxide, indium tin oxide, indium zinc oxide, zinc oxide, or zinc oxide to which gallium is added, can be used for the wiring or the like. Further specifically, a film containing graphene or graphite can be used for the wiring or the like.

For example, a film including graphene oxide is formed and is subjected to reduction, so that a film including graphene can be formed. As a reducing method, a method with application of heat, a method using a reducing agent, or the like can be employed.

A film containing a metal nanowire can be used for the wiring or the like, for example. Specifically, a nanowire containing silver can be used. Specifically, a conductive high molecular compound can be used for the wiring or the like. Note that the terminal 519B can be electrically connected to the flexible printed circuit FPC1 using a conductive material ACF1, for example.

The reflective element 10*a*(*i, j*) is a display element which has a function of controlling the reflection of light, and a liquid crystal element, an electrophoretic element, a display element using MEMS, or the like can be used, for example. Specifically, a reflective liquid crystal display element can be used as the reflective element 10*a*(*i, j*). The use of a reflective display element can reduce power consumption of a display panel.

For example, a liquid crystal element driven in any of the following driving modes can be used: an in-plane switching (IPS) mode, a twisted nematic (TN) mode, a fringe field switching (FFS) mode, an axially symmetric aligned microcell (ASM) mode, an optically compensated birefringence (OCB) mode, a ferroelectric liquid crystal (FLC) mode, an antiferroelectric liquid crystal (AFLC) mode, and the like.

In addition, a liquid crystal element that can be driven by any of the following driving methods can be used: a vertical alignment (VA) mode such as a multi-domain vertical alignment (MVA) mode, a patterned vertical alignment (PVA) mode, an electrically controlled birefringence (ECB) mode, a continuous pinwheel alignment (CPA) mode, and an advanced super view (ASV) mode.

The reflective element 10*a*(*i, j*) includes an electrode 751(*i, j*), an electrode 752, and a layer 753 containing a liquid crystal material. The layer 753 containing a liquid crystal material contains a material whose alignment is controlled by a voltage applied between the electrode 751(*i, j*) and the electrode 752. For example, the alignment of the liquid crystal material can be controlled by an electric field in the thickness direction (also referred to as the vertical direction) of the layer 753 containing a liquid crystal material, or the direction that intersects the vertical direction (the horizontal direction, or the diagonal direction).

A thermotropic liquid crystal, a low-molecular liquid crystal, a high-molecular liquid crystal, a polymer dispersed liquid crystal, a ferroelectric liquid crystal, an anti-ferroelectric liquid crystal, or the like can be used for the layer 753 containing a liquid crystal material, for example. Alternatively, a liquid crystal material which exhibits a cholesteric phase, a smectic phase, a cubic phase, a chiral nematic phase, an isotropic phase, or the like can be used. Alternatively, a liquid crystal material which exhibits a blue phase can be used.

For the electrode 751(*i, j*), a material which is used for wirings and the like can be used, for example. Specifically, a reflective film can be used for the electrode 751(*i, j*). For example, a material in which a conductive film having light-transmitting properties and a reflective film having an opening are stacked can be used for the electrode 751(*i, j*).

For the electrode 752, a material having conductivity can be used, for example. For example, a material having a visible-light-transmitting property can be used for the electrode 752. For example, a conductive oxide, a metal film thin enough to transmit light, or a metal nanowire can be used for the electrode 752. Specifically, a conductive oxide containing indium can be used for the electrode 752. Alternatively, a metal thin film with a thickness greater than or equal to 1 nm and less than or equal to 10 nm can be used for the electrode 752. Alternatively, a metal nanowire containing silver can be used for the electrode 752. Specifically, indium oxide, indium tin oxide, indium zinc oxide, zinc oxide, zinc oxide to which gallium is added, zinc oxide to which aluminum is added, or the like can be used for the electrode 752.

A material reflecting visible light can be used as the reflective film. Specifically, a material containing silver can be used for the reflective film. For example, a material containing silver, palladium, and the like or a material containing silver, copper, and the like can be used for the reflective film. The reflective film reflects light that passes through the layer 753 containing a liquid crystal material, for example. This allows the reflective element 10*a* to serve as a reflective display element. Alternatively, for example, a material with unevenness on its surface can be used for the reflective film. In that case, incident light can be reflected in various directions so that a white image can be displayed.

For example, the electrode 751(*i, j*), or the like can be used as the reflective film. For example, a film including a region positioned between the layer 753 containing a liquid crystal material and the electrode 751(*i, j*) can be used as the reflective film. Alternatively, in the case where the electrode 751(*i, j*) has a light-transmitting property, a film including a region overlapping the layer 753 containing a liquid crystal material with the electrode 751(*i, j*) provided therebetween can be used as the reflective film.

The reflective film preferably includes a region that does not block light emitted from the light-emitting element 10*b*(*i, j*). For example, the reflective film may have a shape with one or a plurality of openings 751H. The opening 751H may have a polygonal shape, a quadrangular shape, an elliptical shape, a circular shape, a cross-like shape, or the like. The opening 751H may also have a stripe shape, a slit-like shape, or a checkered pattern. If the value of the proportion of the total area of the opening 751H to the total area of the unopened portion is too high, an image displayed using the reflective element 10*a*(*i, j*) becomes dark. If the value of the proportion of the total area of the opening 751H to the total area of the unopened portion is too low, an image displayed using the light-emitting element 10*b*(*i, j*) becomes dark.

Shapes of the reflective film that can be used for the pixel of the display unit 110 is described with reference to FIGS. 14A, 14B, and 14C.

Figure 14A:
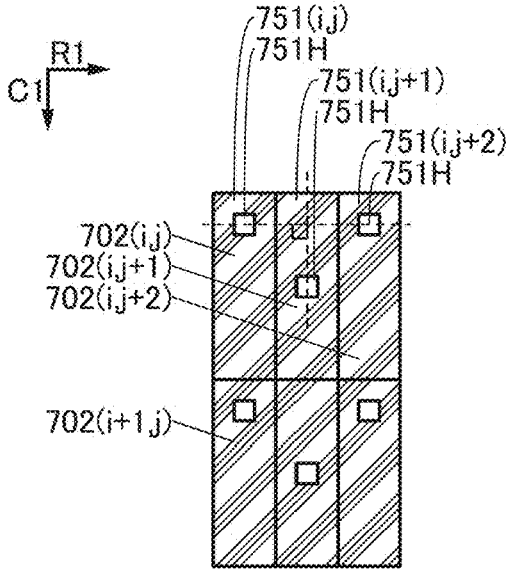
FIGS. 14A, 14B, and 14C are each a schematic diagram illustrating the shape of a reflective film.

For example, the opening 751H of a pixel 702(*i, j*+1), which is adjacent to the pixel 702(*i, j*), is not provided on a line that extends in the row direction (the direction indicated by the arrow R1 in the drawing) through the opening 751H of the pixel 702(*i, j*) (see FIG. 14A). Alternatively, for example, the opening 751H of a pixel 702(*i*+1, j), which is adjacent to the pixel 702(*i, j*), is not provided on a line that extends in the column direction (the direction indicated by the arrow C1 in the drawing) through the opening 751H of the pixel 702(*i, j*) (see FIG. 14B).

For example, the opening 751H of the pixel 702(*i, j*+2) is provided on a line that extends in the row direction through the opening 751H of the pixel 702(*i, j*) (see FIG. 14A). In addition, the opening 751H of the pixel 702(*i, j*+1) is provided on a line that is perpendicular to the above-mentioned line between the opening 751H of the pixel 702(*i, j*) and the opening 751H of the pixel 702(*i, j*+2).

Figure 14B:
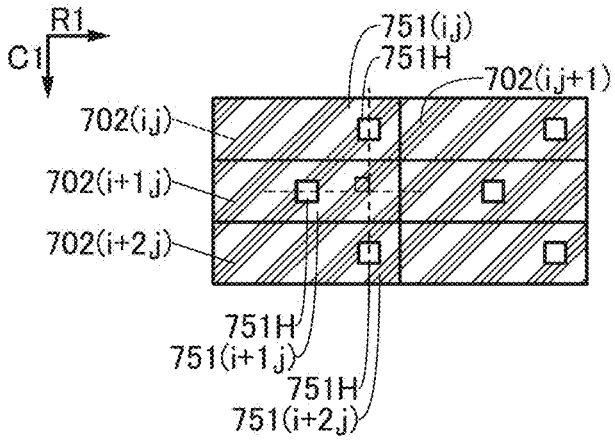

Alternatively, for example, the opening 751H of the pixel 702(*i*+2, j) is provided on a line that extends in the column direction through the opening 751H of the pixel 702(*i, j*) (see FIG. 14B). In addition, for example, the opening 751H of the pixel 702(*i*+1, j) is provided on a line that is perpendicular to the above-mentioned line between the opening 751H of the pixel 702(*i, j*) and the opening 751H of the pixel 702(*i*+2, j).

Thus, a second display element that includes a region overlapping with an opening of a pixel adjacent to one pixel can be apart from a second display element that includes a region overlapping with an opening of the one pixel. Furthermore, a display element that exhibits a color different from that exhibited by the second display element of the one pixel can be provided as the second display element of the pixel adjacent to the one pixel. Furthermore, the difficulty in adjacently arranging a plurality of display elements that exhibit different colors can be lowered.

Figure 14C:
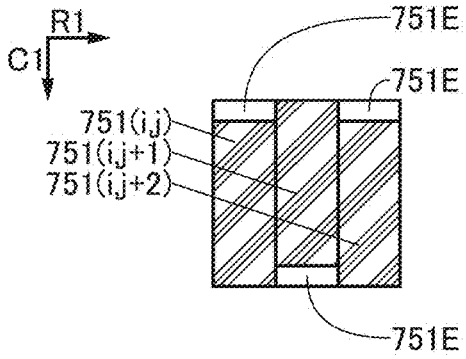

For example, the reflective film can be formed using a material having a shape in which an end portion is cut off so as to form a region 751E that does not block light emitted from the light-emitting element 10*b*(*i, j*) (see FIG. 14C). Specifically, the electrode 751(*i, j*) whose end portion is cut off so as to be shorter in the column direction (the direction indicated by the arrow C1 in the drawing) can be used as the reflective film.

For example, the alignment films AF1 and AF2 can be formed with a material containing polyimide or the like. Specifically, a material formed by rubbing treatment or an optical alignment technique such that a liquid crystal material has a predetermined alignment can be used. For example, a film containing soluble polyimide can be used for the alignment films AF1 and AF2. In this case, the temperature required in forming the alignment film AF1 can be low. Accordingly, damage to other components at the time of forming the alignment film AF1 can be lessened.

A material that transmits light of a predetermined color can be used for the coloring film CF1 or the coloring film CF2. Thus, the coloring film CF1 or the coloring film CF2 can be used as a color filter, for example. For example, a material that transmits blue light, green light, or red light can be used for the coloring film CF1 or the coloring film CF2. Furthermore, a material that transmits yellow light, white light, or the like can be used for the coloring film. Note that a material having a function of converting the emitted light to light of a predetermined color can be used for the coloring film CF2. Specifically, quantum dots can be used for the coloring film CF2. Thus, display with high color purity can be achieved.

A material that prevents light transmission can be used for the light-blocking film BM. This allows the light-blocking film BM to be used as a black matrix, for example.

Materials such as polyimide, epoxy resin, acrylic resin, or the like can be used as the insulating film 771.

An anti-reflection film, a polarizing film, a retardation film, a light diffusion film, a condensing film, or the like can be used for the functional film 770P or the functional film 770D, for example. Specifically, a film containing a dichromatic pigment can be used for the functional film 770P or the functional film 770D. Alternatively, a material with a columnar structure having an axis along the direction intersecting a surface of a base can be used for the functional film 770P or the functional film 770D. In that case, light can be transmitted in the direction along the axis and scattered in other directions easily. Alternatively, an antistatic film preventing the attachment of a foreign substance, a water repellent film suppressing the attachment of stain, a hard coat film suppressing a scratch in use, or the like can be used as the functional film 770P. Specifically, a circularly polarizing film can be used for the functional film 770P. Furthermore, a light diffusion film can be used for the functional film 770D.

For example, an organic electroluminescence element, an inorganic electroluminescence element, a light-emitting diode, or the like can be used as the light-emitting element 10*b*(*i, j*). The light-emitting element 10*b*(*i, j*) includes an electrode 551(*i, j*), an electrode 552, and a layer 553(*j*) containing a light-emitting material. For example, a light-emitting organic compound can be used for the layer 553(*j*). In addition, for example, quantum dots can be used for the layer 553(*j*). Accordingly, the half width becomes narrow, and light of a bright color can be emitted. Furthermore, for example, a stacked-layer material for emitting blue light, green light, or red light, or the like can be used for the layer 553(*j*).

For example, a belt-like stacked-layer material that extends in the column direction along the signal line S2(*j*) can be used for the layer 553(*j*). Alternatively, a layered material for emitting white light can be used for the layer 553(*j*). Specifically, a layered material in which a layer containing a light-emitting material including a fluorescent material that emits blue light, and a layer containing materials that are other than a fluorescent material and that emit green light and/or red light or a layer containing a material that is other than a fluorescent material and that emits yellow light are stacked can be used for the layer 553(*j*).

A material which is used for wirings and the like can be used for the electrode 551(*i, j*). For example, a material that transmits visible light selected from materials that can be used for the wiring or the like can be used for the electrode 551(*i, j*). Specifically, conductive oxide, indium-containing conductive oxide, indium oxide, indium tin oxide, indium zinc oxide, zinc oxide, zinc oxide to which gallium is added, or the like can be used for the electrode 551(; 1*i;i, j*). Alternatively, a metal film that is thin enough to transmit light can be used as the electrode 551(*i, j*). Further alternatively, a metal film that transmits part of light and reflects another part of light can be used as the electrode 551(*i, j*). Thus, the light-emitting element 10*b*(*i, j*) can be provided with a microcavity structure. As a result, light of a predetermined wavelength can be extracted more efficiently than light of other wavelengths.

A material which is used for wirings and the like can be used for the electrode 552. Specifically, a material that reflects visible light can be used for the electrode 552.

Any of a variety of sequential circuits, such as a shift register, can be used as the gate driver GD. For example, a transistor MD, a capacitor, and the like can be used in the gate driver GD.

As the transistor MD, a transistor having a different structure from the transistor that can be used as the switch SW1 can be used, for example. Specifically, a transistor including the conductive film 524 can be used as the transistor MD. In addition, the transistor MD can have the same structure as the transistor M.

For example, semiconductor films formed at the same step can be used for transistors in the gate driver, the source driver, and the pixel circuit. For example, a bottom-gate transistor, a top-gate transistor, or the like can be used for transistors in the gate driver, the source driver, or a pixel circuit. In addition, OS transistors may be used as the transistors. This enables the idling-stop driving described above.

For example, a transistor including an oxide semiconductor film 508, a conductive film 504, a conductive film 512A, and a conductive film 512B can be used as the switch SW1 (see FIG. 13B). Note that an insulating film 506 includes a region positioned between the oxide semiconductor film 508 and the conductive film 504.

The conductive film 504 includes a region overlapping with the oxide semiconductor film 508. The conductive film 504 functions as a gate electrode. The insulating film 506 functions as a gate insulating film. The conductive film 512A and the conductive film 512B are connected to the oxide semiconductor film 508. The conductive film 512A has one of a function as a source electrode and a function as a drain electrode, and the conductive film 512B has the other.

A transistor including the conductive film 524 can be used as the transistor in the gate driver, the source driver, or the pixel circuit. The conductive film 524 includes a region provided in a way that the oxide semiconductor film 508 is positioned between the conductive film 504 and the conductive film 524 in the region. Note that the insulating film 516 includes a region positioned between the conductive film 524 and the oxide semiconductor film 508. In addition, for example, the conductive film 524 is connected to a wiring that supplies the same potential as that supplied to the conductive film 504.

A conductive film in which a 10-nm-thick film containing tantalum and nitrogen and a 300-nm-thick film containing copper are stacked in this order can be used as the conductive film 504, for example. A film containing copper includes a region provided in a way that a film containing tantalum and nitrogen is positioned between the film containing copper and the insulating film 506.

A material in which a 400-nm-thick film containing silicon and nitrogen and a 200-nm-thick film containing silicon, oxygen, and nitrogen are stacked can be used for the insulating film 506, for example. Note that the film containing silicon and nitrogen includes a region so that the film containing silicon, oxygen, and nitrogen is positioned between the film containing silicon and nitrogen and the oxide semiconductor film 508.

A 25-nm-thick film containing indium, gallium, and zinc can be used as the oxide semiconductor film 508, for example.

For example, a conductive film in which a 50-nm-thick film containing tungsten, a 400-nm-thick film containing aluminum, and a 100-nm-thick film containing titanium are stacked in this order can be used as the conductive film 512A or 512B. Note that the film containing tungsten includes a region in contact with the oxide semiconductor film 508.

This embodiment can be combined with any of the other embodiments in this specification as appropriate.

Figure 15A:
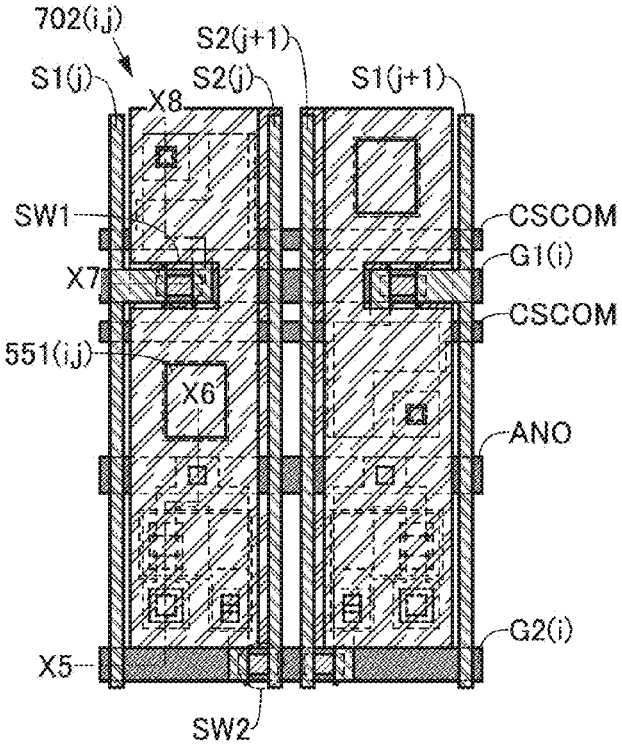
FIGS. 15A and 15B are each a bottom view illustrating part of a pixel of a display unit.
Figure 15B:
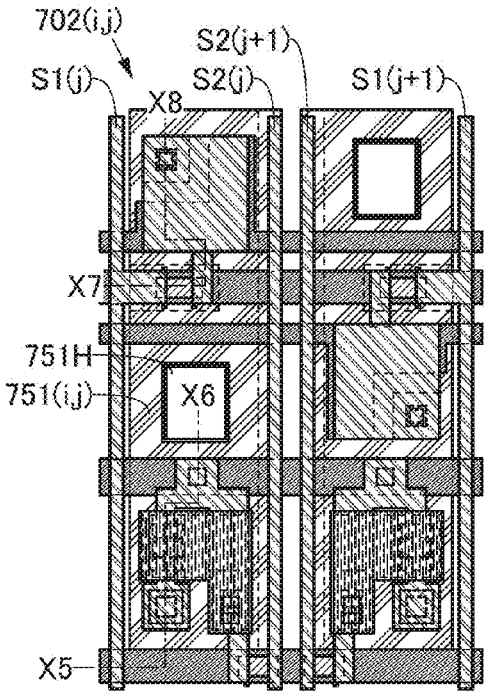

FIG. 15A is a bottom view illustrating part of the pixel of the display panel in FIG. 11B. FIG. 15B is a bottom view illustrating part of the structure in FIG. 15A in which some components are omitted.

Embodiment 4

Figure 16:
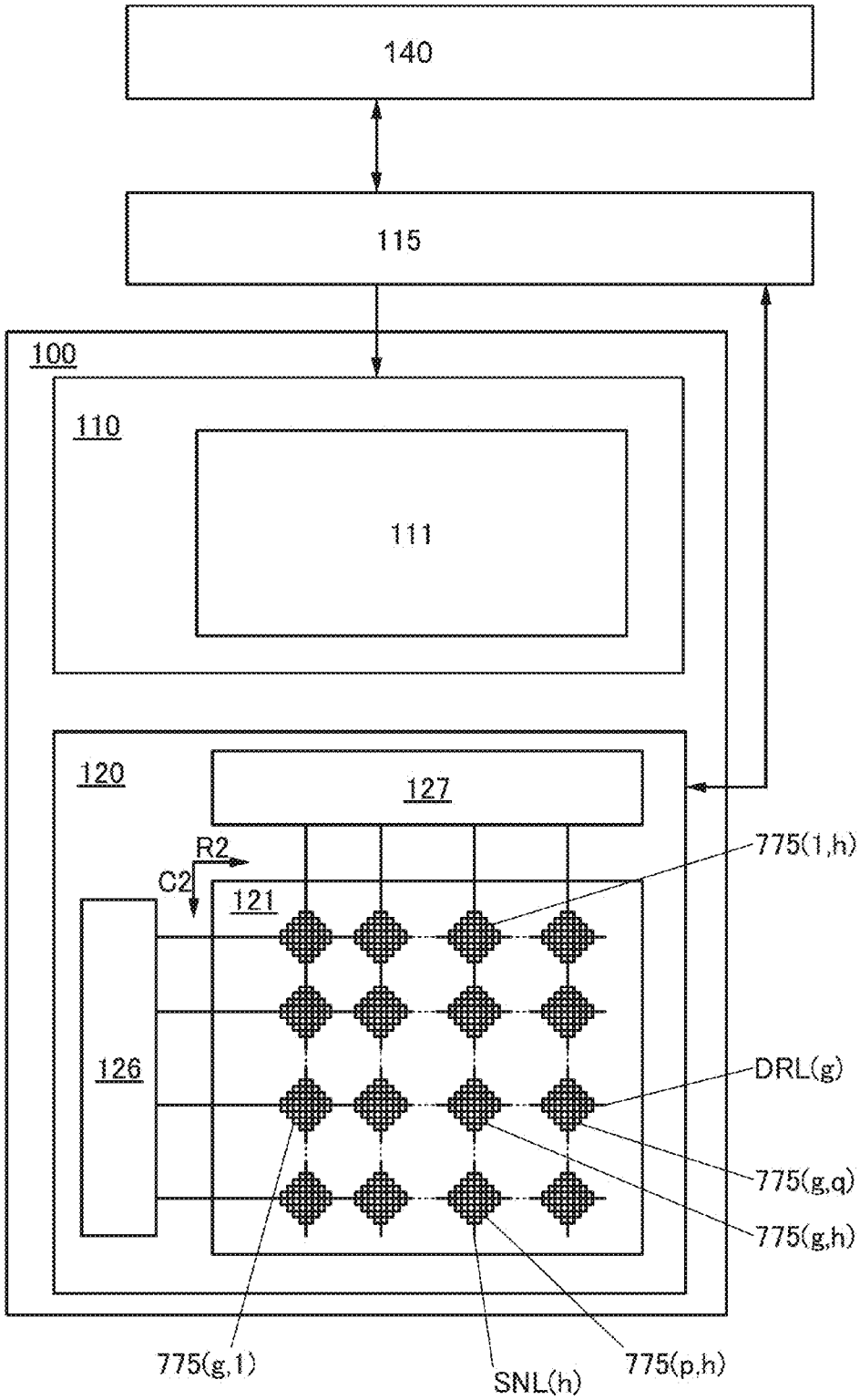
FIG. 16 is a block diagram illustrating a configuration example of a display device.
Figure 17A:
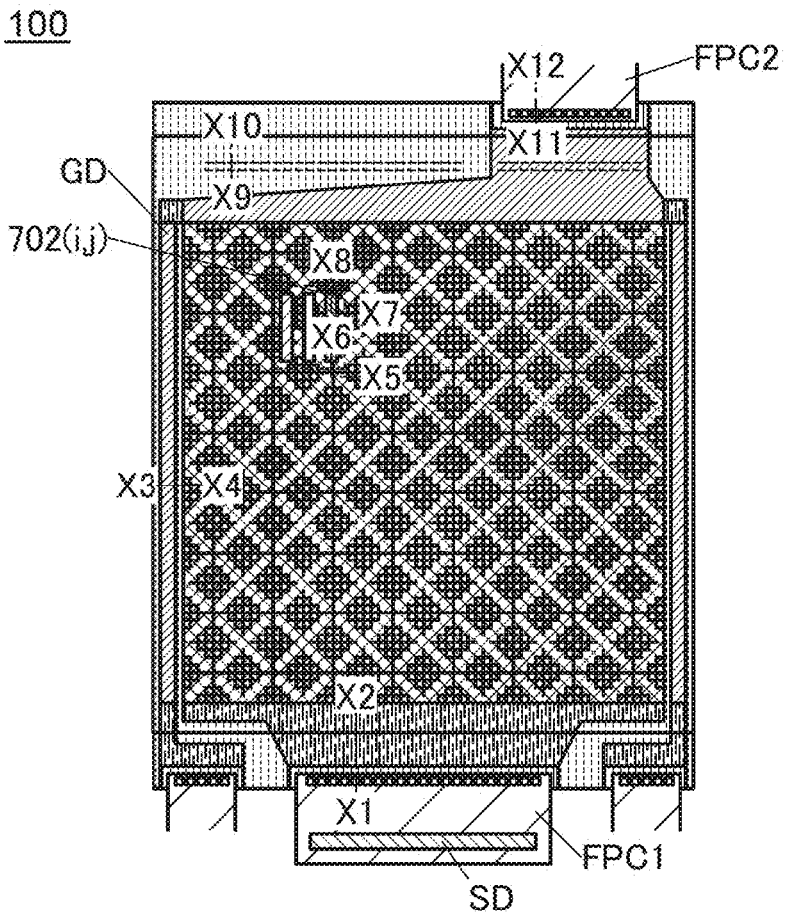
FIG. 17A is a top view illustrating a display device.
Figure 17B:
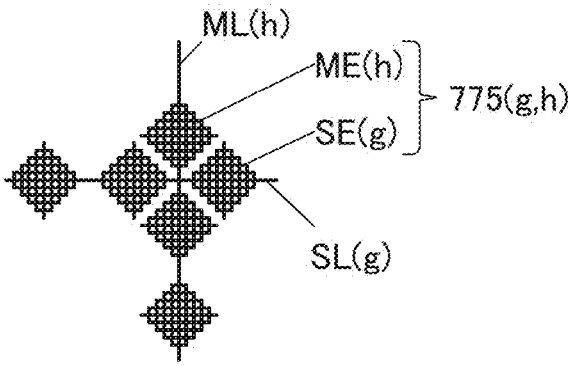
FIG. 17B is a schematic diagram illustrating part of an input portion of the display device.
Figure 18A:
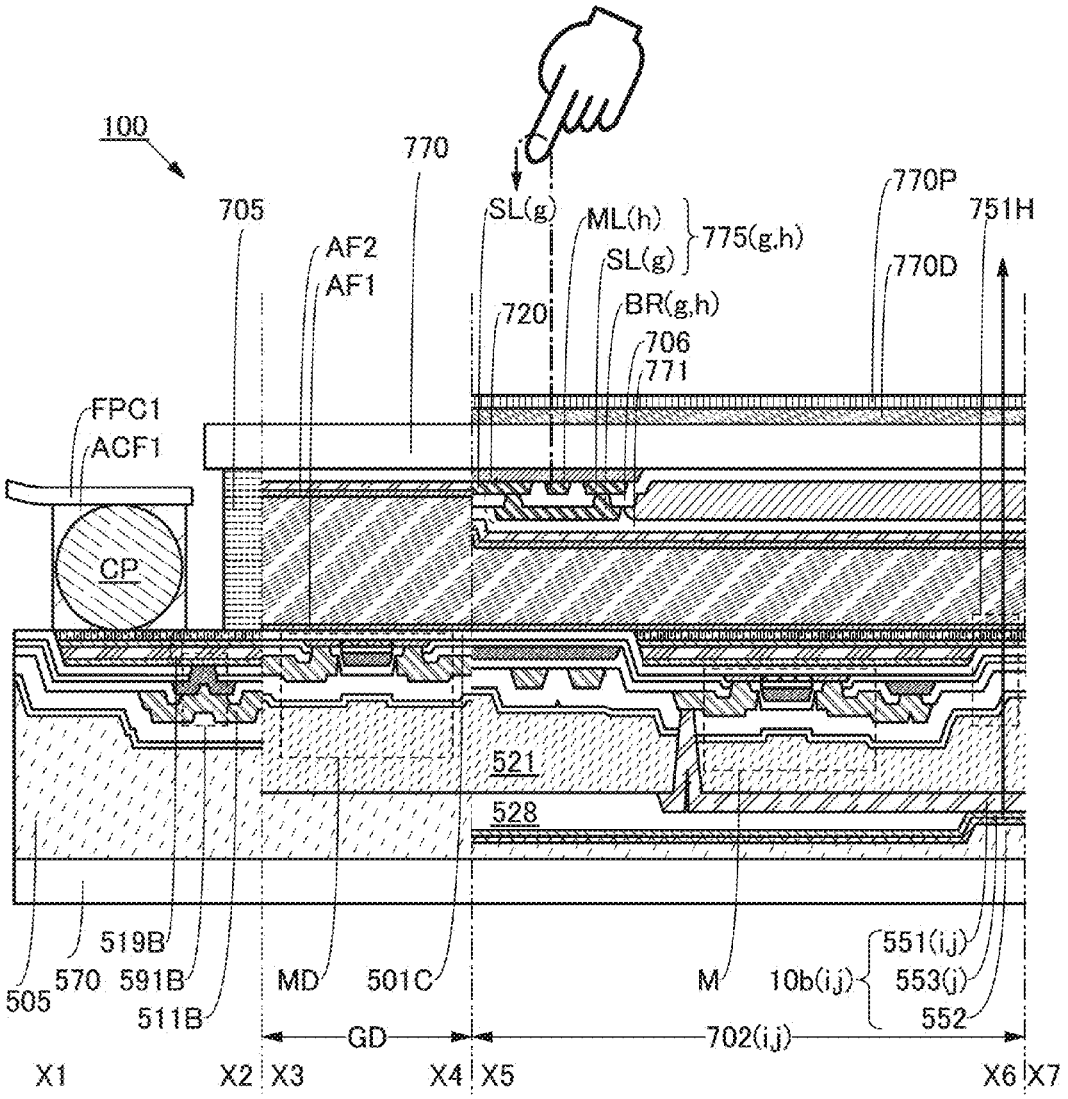
FIGS. 18A and 18B are each a cross-sectional view illustrating a configuration example of a display device.
Figure 18B:
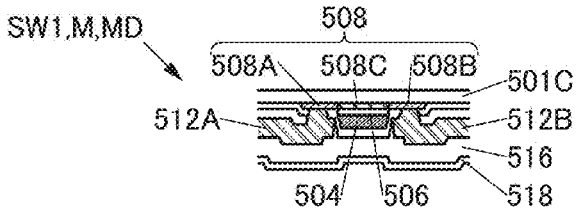
Figure 19:
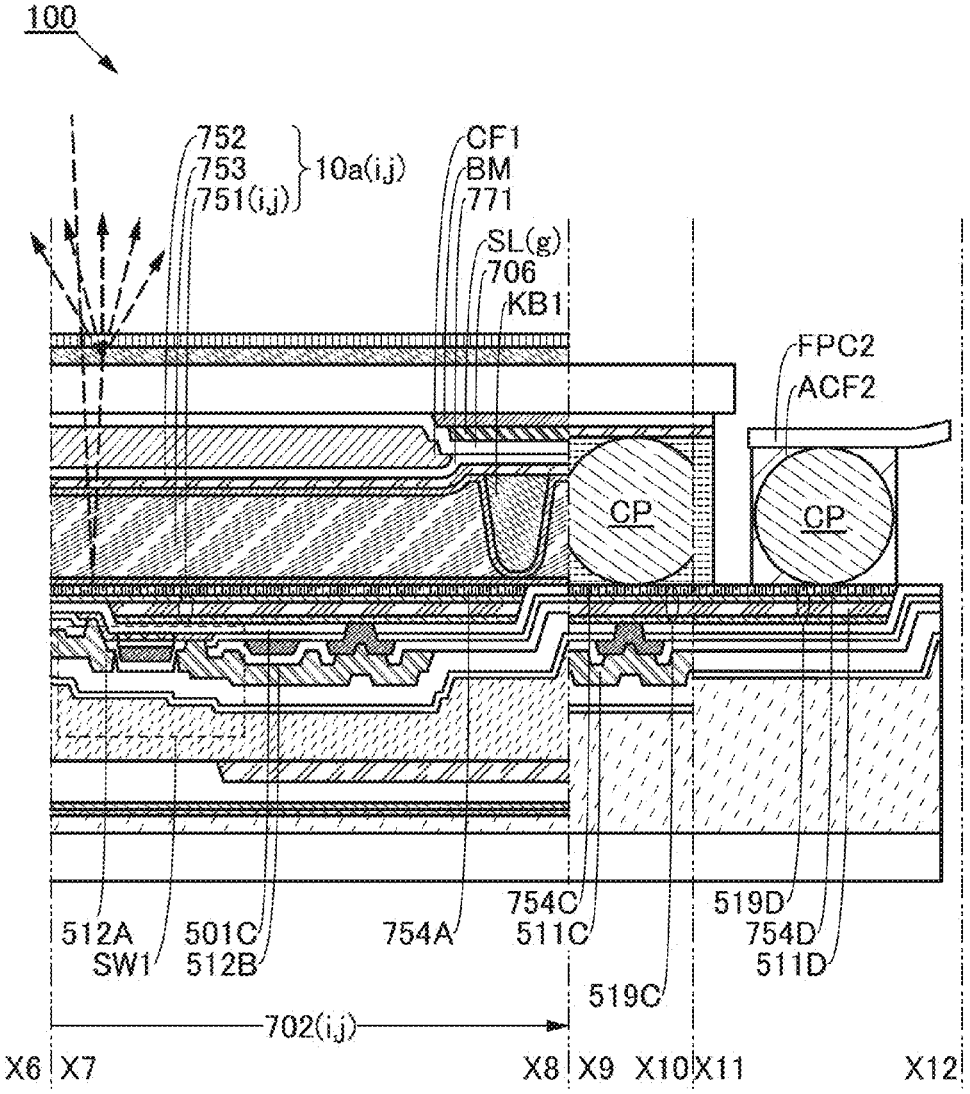
FIG. 19 is a cross-sectional view illustrating a configuration example of a display device.

A display device including a display unit and a touch sensor unit is described with reference to FIG. 16, FIGS. 17A and 17B, FIGS. 18A and 18B, and FIG. 19. FIG. 16 is a block diagram illustrating the display device 100 with the display unit 110 and the touch sensor unit 120. FIG. 17A is a top view of the display device 100, and FIG. 17B illustrates part of an input portion of the display device 100. FIG. 18A illustrates a cross-sectional structure along lines X1-X2, X3-X4, and X5-X6 in FIG. 17A. FIG. 18B illustrates part of the structure illustrated in FIG. 18A. FIG. 19 illustrates a cross-sectional structure along lines X7-X8, X9-X10, and X11-X12 in FIG. 17A.

The touch sensor unit 120 includes the sensor array 121, the TS driver 126, and the sensing circuit 127 (see FIG. 16).

The sensor array 121 is positioned so as to overlap with the pixel array 111 of the display unit 110, and the sensor array 121 has a function of sensing an object that approaches the region where the sensor array 121 overlaps with the pixel array 111. The sensor array 121 includes a group consisting of sensing elements 775(*g*, 1) to 775(*g, q*) and another group consisting of sensing elements 775(1, *h*) to 775(*p, h*). Note that g is an integer greater than or equal to 1 and less than or equal top, h is an integer greater than or equal to 1 and less than or equal to q, and each of p and q is an integer greater than or equal to 1.

The one group of sensing elements 775(*g*, 1) to 775(*g, q*) include the sensing element 775(*g, h*). The one group of sensing elements 775(*g*, 1) to 775(*g, q*) are arranged in a row direction (the direction indicated by an arrow R2 in the drawing). The other group of sensing elements 775(1, *h*) to 775(*p, h*) include the sensing element 775(*g, h*) and are arranged in a column direction (the direction indicated by an arrow C2 in the drawing) that intersects with the row direction.

The one group of sensing elements 775(*g*, 1) to 775(*g, q*) provided in the row direction include an electrode SE(g) that is connected to a control line SL(g) (see FIG. 17B). The another group of sensing elements 775(1, *h*) to 775(*p, h*) provided in the column direction include the electrode ME(h) that is electrically connected to the sensor signal line ML(h) (see FIG. 17B).

The electrode SE(g) and the electrode ME(h) preferably have light-transmitting properties. The wiring DRL(g) has a function of supplying a control signal. The wiring SNL(h) has a function of receiving a sensor signal. The electrode ME(h) is provided so that an electric field can be formed between the electrode ME(h) and the electrode SE(g). When an object such as a finger approaches the sensor array 121, the electric field is blocked, and the sensing element 775(*g, h*) supplies the sensor signal.

The TS driver 126 is connected to the wiring DRL(g) and has a function of supplying the control signal. For example, a rectangular wave, a sawtooth wave, a triangular wave, or the like can be used as the control signal.

The sensing circuit 127 is connected to the wiring SNL(h) and has a function of supplying the sensor signal in response to the change in the potential of the wiring SNL(h). Note that the sensor signal includes, for example, positional data. The sensor signal is supplied to the controller IC 115. The controller IC 115 supplies data corresponding to the sensor signal to the host 140 to update the image displayed with the pixel array 111.

The display device 100 in FIGS. 18A and 18B and FIG. 19 is different from the display unit 110 in FIGS. 12A and 12B and FIGS. 13A and 13B in that the display device 100 includes a functional layer 720 and a top-gate transistor. Their structural differences will be described in detail below, and the above description is referred to for the portions that can use similar structures.

The functional layer 720 includes a region surrounded by the substrate 770, the insulating film 501C, and the sealant 705 (see FIGS. 18A and 18B). The functional layer 720 includes the wiring DRL(g), the wiring SNL(h), and the sensing element 775(*g, h*). Note that the gap between the wiring DRL(g) and the second electrode 752 or between the wiring SNL(h) and the second electrode 752 is greater than or equal to 0.2 μm and less than or equal to 16 μm, preferably greater than or equal to 1 μm and less than or equal to 8 μm, further preferably greater than or equal to 2.5 μm and less than or equal to 4 μm.

In addition, the display device 100 includes a conductive film 511D (see FIG. 19). Note that a conductive material CP or the like can be provided between the wiring DRL(g) and the conductive film 511D to electrically connect the wiring DRL(g) and the conductive film 511D. In addition, the conductive material CP or the like can be provided between the wiring SNL(h) and the conductive film 511D to electrically connect the wiring SNL(h) and the conductive film 511D. A material which is used for wirings or the like can be used for the conductive film 511D.

The display device 100 includes a terminal 519D (see FIG. 19). The terminal 519D includes the conductive film 511D and an intermediate film 754D. The intermediate film 754D includes a region in contact with a conductive film 511D. A material that can be used for the wiring or the like can be used for the terminal 519D. Specifically, the terminal 519D can have the same structure as that of the terminal 519B or the terminal 519C.

Note that the terminal 519D can be electrically connected to the flexible printed circuit FPC2 using a conductive material ACF2, for example. Thus, a control signal can be supplied to the wiring DRL(g) with use of the terminal 519D, for example. Alternatively, a sensor signal can be supplied from the wiring SNL(h) with use of the terminal 519D.

A transistor that can be used for the switch SW1, the transistor M, and the transistor MD include the conductive film 504 having a region overlapping with the insulating film 501C and the oxide semiconductor film 508 having a region positioned between the insulating film 501C and the conductive film 504. Note that the conductive film 504 functions as a gate electrode (see FIG. 18B).

The oxide semiconductor film 508 includes a first region 508A, a second region 508B, and a third region 508C. The first region 508A and the second region 508B do not overlap with the conductive film 504. The third region 508C is positioned between the first region 508A and the second region 508B and overlaps with the conductive film 504.

The transistor MD includes the insulating film 506 between the third region 508C and the conductive film 504. Note that the insulating film 506 serves as a gate insulating film. The first region 508A and the second region 508B have a lower resistivity than the third region 508C, and serve as a source region or a drain region.

For example, an oxide semiconductor film is subjected to plasma treatment using a gas including a rare gas, so that the first region 508A and the second region 508B can be formed in the oxide semiconductor film 508. The conductive film 504 can be used as a mask, for example, in which case part of the third region 508C can be self-aligned to an end portion of the conductive film 504.

The transistor MD includes the conductive film 512A and the conductive film 512B that are in contact with the first region 508A and the second region 508B, respectively. The conductive film 512A and the conductive film 512B each function as a source electrode or a drain electrode. A transistor that can be fabricated in the same process as the transistor MD can be used as the transistor M.

Embodiment 5

In this embodiment, electronic devices are described with reference to FIGS. 20A to 20H.

FIGS. 20A to 20H each illustrate an electronic device. These electronic devices can include a housing 5000, a display portion 5001, a speaker 5003, an LED lamp 5004, operation keys 5005 (including a power switch and an operation switch), a connection terminal 5006, a sensor 5007 (a sensor having a function of measuring force, displacement, position, speed, acceleration, angular velocity, rotational frequency, distance, light, liquid, magnetism, temperature, chemical substance, sound, time, hardness, electric field, current, voltage, electric power, radiation, flow rate, humidity, gradient, oscillation, odor, or infrared ray), a microphone 5008, and the like.

Figure 20A:
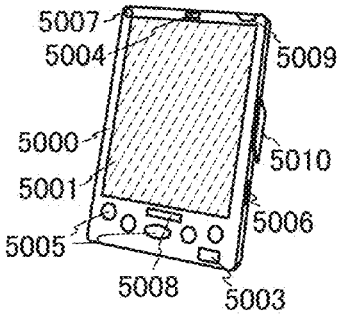
FIGS. 20A, 20B, 20C, 20D, 20E, 20F, 20G, and 20H are perspective views each illustrating an example of an electronic device.
Figure 20B:
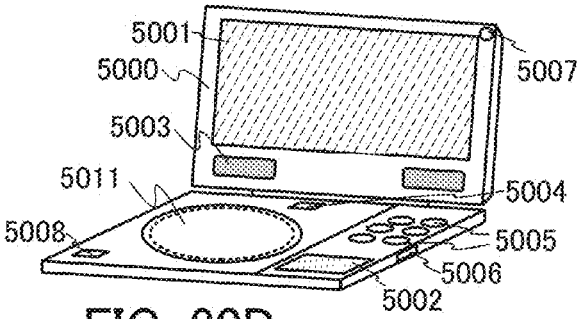
Figure 20C:
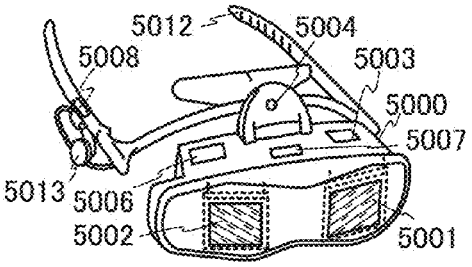
Figure 20D:
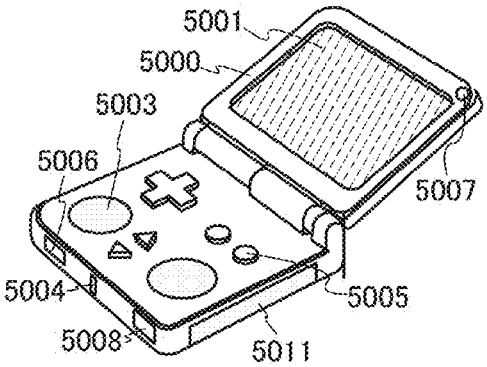
Figure 20E:
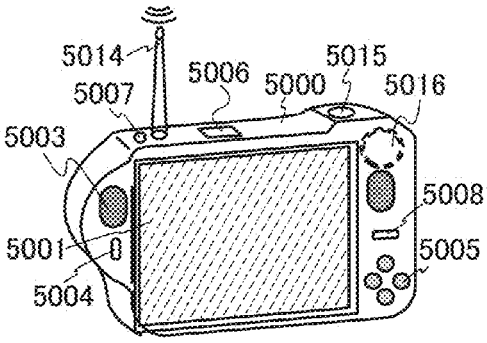
Figure 20F:
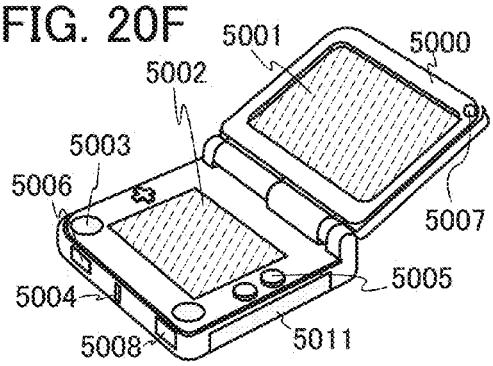
Figure 20G:
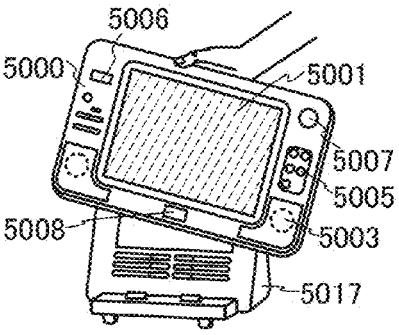

FIG. 20A illustrates a mobile computer which can include a switch 5009, an infrared port 5010, and the like in addition to the above components. FIG. 20B illustrates a portable image reproducing device (e.g., a DVD player) provided with a recording medium, and the portable image reproducing device can include a second display portion 5002, a recording medium reading portion 5011, and the like in addition to the above components. FIG. 20C illustrates a goggle-type display which can include the second display portion 5002, a support portion 5012, an earphone 5013, and the like in addition to the above components. FIG. 20D illustrates a portable game console which can include the recording medium reading portion 5011 and the like in addition to the above components. FIG. 20E illustrates a digital camera with a television reception function, and the digital camera can include an antenna 5014, a shutter button 5015, an image receiving portion 5016, and the like in addition to the above components. FIG. 20F illustrates a portable game console which can include the second display portion 5002, the recording medium reading portion 5011, and the like in addition to the above components. FIG. 20G illustrates a portable television receiver which can include a charger 5017 capable of transmitting and receiving signals, and the like in addition to the above components.

The electronic devices illustrated in FIGS. 20A to 20G can have a variety of functions. For example, the electronic devices can have a function of displaying a variety of data (e.g., a still image, a moving image, and a text image) on the display portion, a touch panel function, a function of displaying a calendar, date, time, and the like, a function of controlling processing with a variety of software (programs), a wireless communication function, a function of being connected to a variety of computer networks with a wireless communication function, a function of transmitting and receiving a variety of data with a wireless communication function, and a function of reading out a program or data stored in a recording medium and displaying it on the display portion. Furthermore, the electronic device including a plurality of display areas can have a function of displaying image information mainly on one display area while displaying text information on another display area, a function of displaying a three-dimensional image by displaying images where parallax is considered on a plurality of display areas, or the like. Furthermore, the electronic device including an image receiver can have a function of shooting a still image, a function of taking a moving image, a function of automatically or manually correcting a shot image, a function of storing a shot image in a memory medium (an external memory medium or a memory medium incorporated in the camera), a function of displaying a shot image on the display area, or the like. Note that functions that can be provided for the electronic devices illustrated in FIGS. 20A to 20G are not limited to those described above, and the electronic devices can have a variety of functions.

Figure 20H:
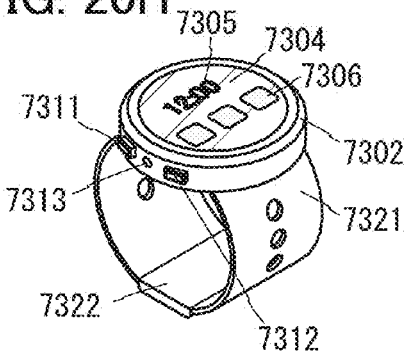

FIG. 20H illustrates a smart watch, which includes a housing 7302, a display panel 7304, operation buttons 7311 and 7312, a connection terminal 7313, a band 7321, a clasp 7322, and the like.

The display panel 7304 mounted in the housing 7302 serving as a bezel includes a non-rectangular display region. The display panel 7304 may have a rectangular display region. The display panel 7304 can display an icon 7305 indicating time, another icon 7306, and the like.

Note that the smart watch in FIG. 20H can have a variety of functions. For example, the smart watch can have a function of displaying a variety of data (e.g., a still image, a moving image, and a text image) on the display portion, a touch panel function, a function of displaying a calendar, date, time, and the like, a function of controlling processing with a variety of software (programs), a wireless communication function, a function of being connected to a variety of computer networks with a wireless communication function, a function of transmitting and receiving a variety of data with a wireless communication function, and a function of reading out a program or data stored in a recording medium and displaying it on the display portion.

The housing 7302 can include a speaker, a sensor (a sensor having a function of measuring force, displacement, position, speed, acceleration, angular velocity, rotational frequency, distance, light, liquid, magnetism, temperature, chemical substance, sound, time, hardness, electric field, current, voltage, electric power, radiation, flow rate, humidity, gradient, oscillation, odor, or infrared rays), a microphone, and the like. Note that the smart watch can be manufactured using the light-emitting element for the display panel 7304.

This application is based on Japanese Patent Application serial No. 2016-147070 filed with Japan Patent Office on Jul. 27, 2016, the entire contents of which are hereby incorporated by reference.

What is claimed is:

1. A semiconductor device comprising:

an image processing portion comprising a first functional circuit and a second functional circuit and electrically connected to a source driver;

a first scan chain electrically connected to the first functional circuit;

a second scan chain electrically connected to the second functional circuit;

a controller electrically connected to the first scan chain and the second scan chain;

a first selector between the first scan chain and the controller;

a second selector between the second scan chain and the controller; and an input terminal, wherein the controller is configured to supply control data to the first selector and the second selector where data supplied from the input terminal does not pass through the first scan chain and pass the second scan chain, wherein the data that passes through the second scan chain supplies to the second functional circuit where a parameter stored in the second functional circuit is rewritten, and wherein the second functional circuit is configured to correct image data using the parameter and supply the corrected image data to the source driver.

2. The semiconductor device according to claim 1, further comprising:

a first logic circuit electrically connected to the first scan chain and a clock line; and a second logic circuit electrically connected to the second scan chain and the clock line, wherein the controller is configured to supply control data to the first logic circuit and the second logic circuit.

3. The semiconductor device according to claim 1, further comprising:

a first logic circuit electrically connected to the first scan chain and a clock line; and a second logic circuit electrically connected to the second scan chain and the clock line, wherein a clock signal is output from the clock line to the first scan chain by the first logic circuit and the second logic circuit, and wherein the clock signal is not output to the second scan chain by the first logic circuit and the second logic circuit.

4. The semiconductor device according to claim 1, further comprising a module connector electrically connected to the first functional circuit and the second functional circuit.

5. An electronic device comprising the semiconductor device according to claim 1.

6. A semiconductor device comprising:

an image processing portion comprising a first functional circuit and a second functional circuit and electrically connected to a source driver;

a first scan chain electrically connected to the first functional circuit;

a second scan chain electrically connected to the second functional circuit;

a controller electrically connected to the first scan chain and the second scan chain;

a first selector between the first scan chain and the controller;

a second selector between the second scan chain and the controller;

an input terminal;

a first transistor between the first scan chain and the controller; and a second transistor between the second scan chain and the controller, wherein a channel formation region of each of the first transistor and the second transistor comprises an oxide semiconductor, and wherein the controller is configured to supply control data to the first selector and the second selector where data supplied from the input terminal does not pass through the first scan chain and pass the second scan chain, wherein the data that passes through the second scan chain supplies to the second functional circuit where a parameter stored in the second functional circuit is rewritten, and wherein the second functional circuit is configured to correct image data using the parameter and supply the corrected image data to the source driver.

7. The semiconductor device according to claim 6, further comprising:

a first logic circuit electrically connected to the first scan chain and a clock line; and a second logic circuit electrically connected to the second scan chain and the clock line, wherein the controller is configured to supply control data to the first logic circuit and the second logic circuit.

8. The semiconductor device according to claim 6, further comprising:

a first logic circuit electrically connected to the first scan chain and a clock line; and a second logic circuit electrically connected to the second scan chain and the clock line, wherein a clock signal is output from the clock line to the first scan chain by the first logic circuit and the second logic circuit, and wherein the clock signal is not output to the second scan chain by the first logic circuit and the second logic circuit.

9. The semiconductor device according to claim 6, further comprising a module connector electrically connected to the first functional circuit and the second functional circuit.

10. The semiconductor device according to claim 6, further comprising a pixel comprising a reflective element and a light-emitting element, wherein at least one of the first functional circuit and the second functional circuit is a color adjustment circuit configured to store a parameter to adjust a color tone of at least one of the reflective element and the light-emitting element.

11. The semiconductor device according to claim 6, further comprising a pixel comprising a reflective element and a light-emitting element, wherein at least one of the first functional circuit and the second functional circuit is a dimming circuit configured to store a parameter to adjust a reflection intensity of the reflective element and an emission intensity of the light-emitting element.

12. The semiconductor device according to claim 6, further comprising a pixel comprising a reflective element and a light-emitting element, wherein at least one of the first functional circuit and the second functional circuit is a gamma correction circuit configured to store a gamma value.

13. An electronic device comprising the semiconductor device according to claim 6.

* * * * *